US008953980B2

(12) United States Patent
Takiguchi et al.

(10) Patent No.: US 8,953,980 B2
(45) Date of Patent: Feb. 10, 2015

(54) MEMBER MOUNTING STRUCTURE AND IMAGE FORMING APPARATUS

(71) Applicant: Fuji Xerox Co., Ltd., Minato-ku, Tokyo (JP)

(72) Inventors: Toshio Takiguchi, Kanagawa (JP); Tadashi Ito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 68 days.

(21) Appl. No.: 13/753,101

(22) Filed: Jan. 29, 2013

(65) Prior Publication Data

US 2013/0294798 A1 Nov. 7, 2013

(30) Foreign Application Priority Data

May 1, 2012 (JP) ..... 2012-104699

(51) Int. Cl.

| | |
|---|---|
| ***G03G 15/00*** | (2006.01) |
| ***G03G 21/12*** | (2006.01) |
| ***G03G 21/10*** | (2006.01) |
| ***G03G 21/16*** | (2006.01) |
| ***G03G 21/18*** | (2006.01) |

(52) U.S. Cl.

CPC ..... *G03G 21/10* (2013.01); *G03G 21/1647* (2013.01); *G03G 21/12* (2013.01); *G03G 21/1853* (2013.01)

USPC ..... 399/110; 399/360

(58) Field of Classification Search

USPC ..... 399/110, 360

See application file for complete search history.

(56) References Cited

U.S. PATENT DOCUMENTS

| | | | | |
|---|---|---|---|---|
| 2011/0076055 | A1* | 3/2011 | Lee et al. | 399/110 |
| 2011/0123207 | A1* | 5/2011 | Sato et al. | 399/360 X |

FOREIGN PATENT DOCUMENTS

| | | | |
|---|---|---|---|
| JP | 2002-123051 | A | 4/2002 |
| JP | 2002-278414 | A | 9/2002 |

* cited by examiner

*Primary Examiner* — Sandra Brase

(74) *Attorney, Agent, or Firm* — Sughrue Mion, PLLC

(57) ABSTRACT

A member mounting structure includes: a removable member mountable to and removable from an apparatus body upon application of a moving force in a first direction; a moving member that moves the removable member in a second direction intersecting the first direction when the removable member is moved in the first direction to be mounted to the apparatus body to dispose the removable member at a mounting position with respect to the apparatus body; a restriction member that restricts movement of the removable member at the mounting position toward a removal side in the first direction; and a suppression member that is mountable to and removable from the apparatus body when moved in the first direction and that suppresses movement of the removable member at the mounting position toward a restriction removing side in the second direction for removal of restriction imposed by the restriction member.

8 Claims, 19 Drawing Sheets

MEMBER MOUNTING STRUCTURE AND IMAGE FORMING APPARATUS

CROSS-REFERENCE TO RELATED APPLICATIONS

This application is based on and claims priority under 35 USC 119 from Japanese Patent Application No. 2012-104699 filed May 1, 2012.

BACKGROUND

Technical Field

The present invention relates to a member mounting structure and an image forming apparatus.

SUMMARY

According to an aspect of the present invention, there is provided a member mounting structure including: a removable member mountable to and removable from an apparatus body by applying a moving force in a first direction to the removable member; a moving member that moves the removable member in a second direction intersecting the first direction when the removable member is moved in the first direction to be mounted to the apparatus body to dispose the removable member at a mounting position with respect to the apparatus body; a restriction member that restricts movement of the removable member disposed at the mounting position toward a removal side in the first direction; and a suppression member that is mountable to and removable from the apparatus body by moving the suppression member in the first direction and that suppresses movement of the removable member disposed at the mounting position toward a restriction removing side in the second direction on which restriction imposed by the restriction member is removed.

BRIEF DESCRIPTION OF THE DRAWINGS

An exemplary embodiment of the present invention will be described in detail based on the following figures, wherein.

DETAILED DESCRIPTION

Figure 1:
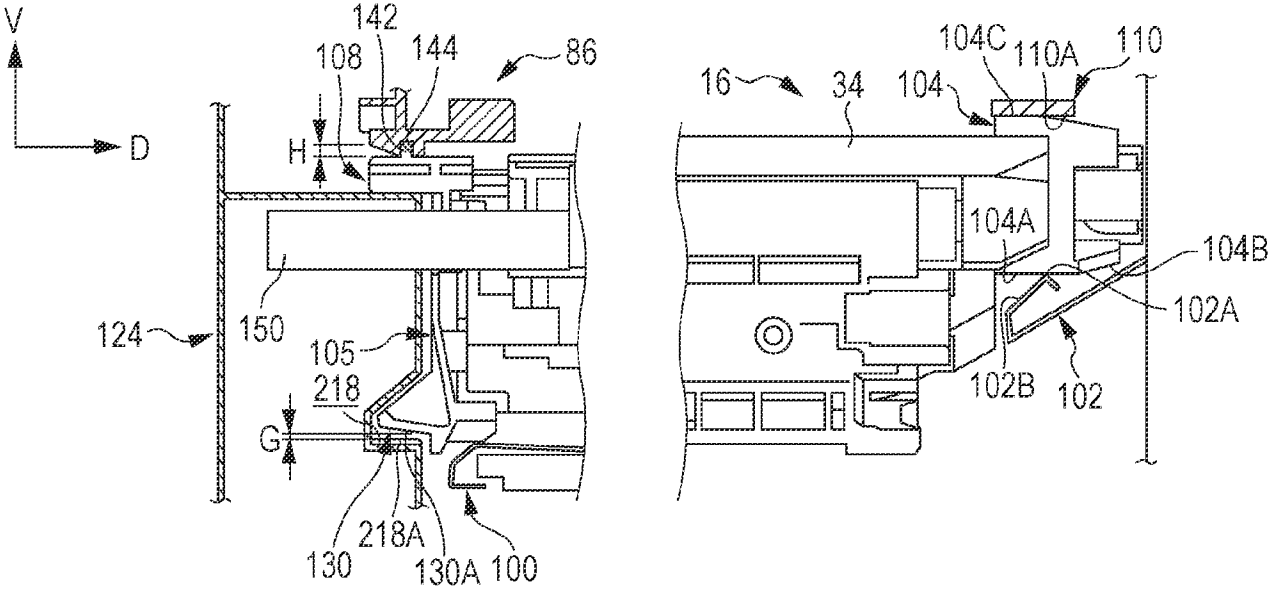
FIG. 1 is a cross-sectional view showing an image forming unit etc. provided in an image forming apparatus according to an exemplary embodiment of the present invention.

Examples of a member mounting structure according to an exemplary embodiment of the present invention and an image forming apparatus including the member mounting structure will be described with reference to FIGS. 1 to 19. In the drawings, the arrow V indicates the vertical direction, the arrow H indicates a horizontal direction corresponding to the apparatus width direction, and the arrow D indicates a horizontal direction corresponding to the apparatus depth direction.

(Overall Configuration)

Figure 19:
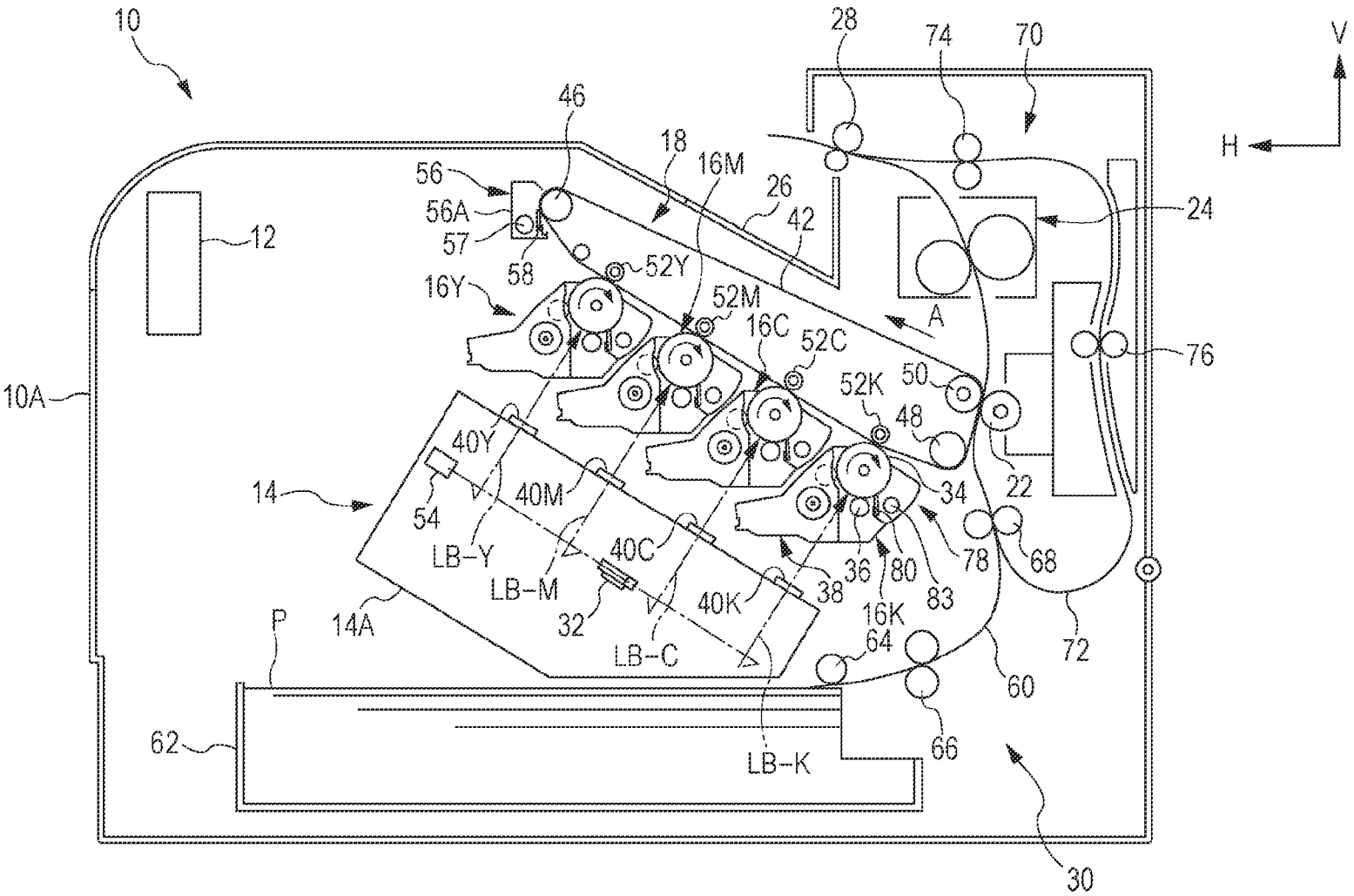
FIG. 19 shows a schematic configuration of the image forming apparatus according to the exemplary embodiment of the present invention.

As shown in FIG. 19, an image processing section 12 is provided inside an apparatus body 10A of an image forming apparatus 10. The image processing section 12 performs image processing on input image data.

The image processing section 12 processes the input image data into tone data for four colors including yellow (Y), magenta (M), cyan (C), and black (K). An exposure device 14 is provided around the center of a space inside the apparatus body 10A. The exposure device 14 receives the tone data processed by the image processing section 12 to perform image exposure using laser light LB.

Four image forming units 16Y, 16M, 16C, and 16K for yellow (Y), magenta (M), cyan (C), and black (K) colors serving as examples of a removable member are provided above the exposure device 14 in the vertical direction, and disposed at intervals in a direction inclined with respect to the horizontal direction. The image forming units 16Y, 16M, 16C, and 16K are mountable to and removable from the apparatus body 10A. The image forming units 16Y, 16M, 16C, and 16K form a toner image for each color. In the case where there is no need to differentiate among Y, M, C, and K, the symbols Y, M, C, K may be omitted.

A first transfer unit 18 is provided above the image forming units 16 for each color in the vertical direction. The toner images formed by the image forming units 16 for each color are transferred onto the first transfer unit 18 in a multiplexed manner. A second transfer roller 22 is provided at a side (on the right side in the drawing) of the first transfer unit 18. The second transfer roller 22 transfers the toner images, which have been transferred to the first transfer unit 18 in a multiplexed manner, onto a sheet member P serving as a recording medium transported along a transport path 60 by a feed/transport unit 30 to be discussed later.

A fixing device 24 is provided downstream of the second transfer roller 22 in the direction of transport of the sheet member P. The fixing device 24 fixes the toner images, which have been transferred to the sheet member P, onto the sheet member using heat and a pressure. An ejection roller 28 is provided downstream of the fixing device 24 in the direction of transport of the sheet member P. The ejection roller 28 ejects the sheet member P, to which the toner images have been fixed, to an ejection section 26 provided at an upper portion of the apparatus body 10A of the image forming apparatus 10.

A feed/transport unit 30 is provided vertically below and at a side of the exposure device 14 to feed and transport the sheet member P.

[Image Forming Units]

First, the image forming units 16 will be described.

The image forming units 16 for each color are all formed in the same manner. The image forming unit 16 for each color includes an image holding member 34 that is cylindrical and rotatable, and a charging member 36 that charges the outer peripheral surface of the image holding member 34. The image forming unit 16 for each color further includes a developer 38 that develops an electrostatic latent image formed on the outer peripheral surface of the image holding member 34, which has been charged, by image exposure performed by the exposure device 14 discussed earlier using a developing agent (toner) to obtain a toner image, and a cleaning blade (not shown) that cleans the outer peripheral surface of the image holding member 34.

The image forming unit 16 further includes a removal member 78 that removes residual toner that remains on the image holding member 34 after the toner image is transferred onto an intermediate transfer belt 42. The removal member 78 is disposed on the outer periphery of the image holding member 34 at a location downstream of the position of transfer onto the intermediate transfer belt 42 in the rotational direction of the image holding member 34 and upstream of the charging member 36 in the rotational direction of the image holding member 34.

The removal member 78 includes a removal blade 80 that contacts the image holding member 34 to remove residual toner remaining on the image holding member 34, and a transport auger 83 that transports the waste toner (residual toner) removed by the removal blade 80 to a waste toner box 124 (see FIG. 8) to be discussed later.

Figure 14:
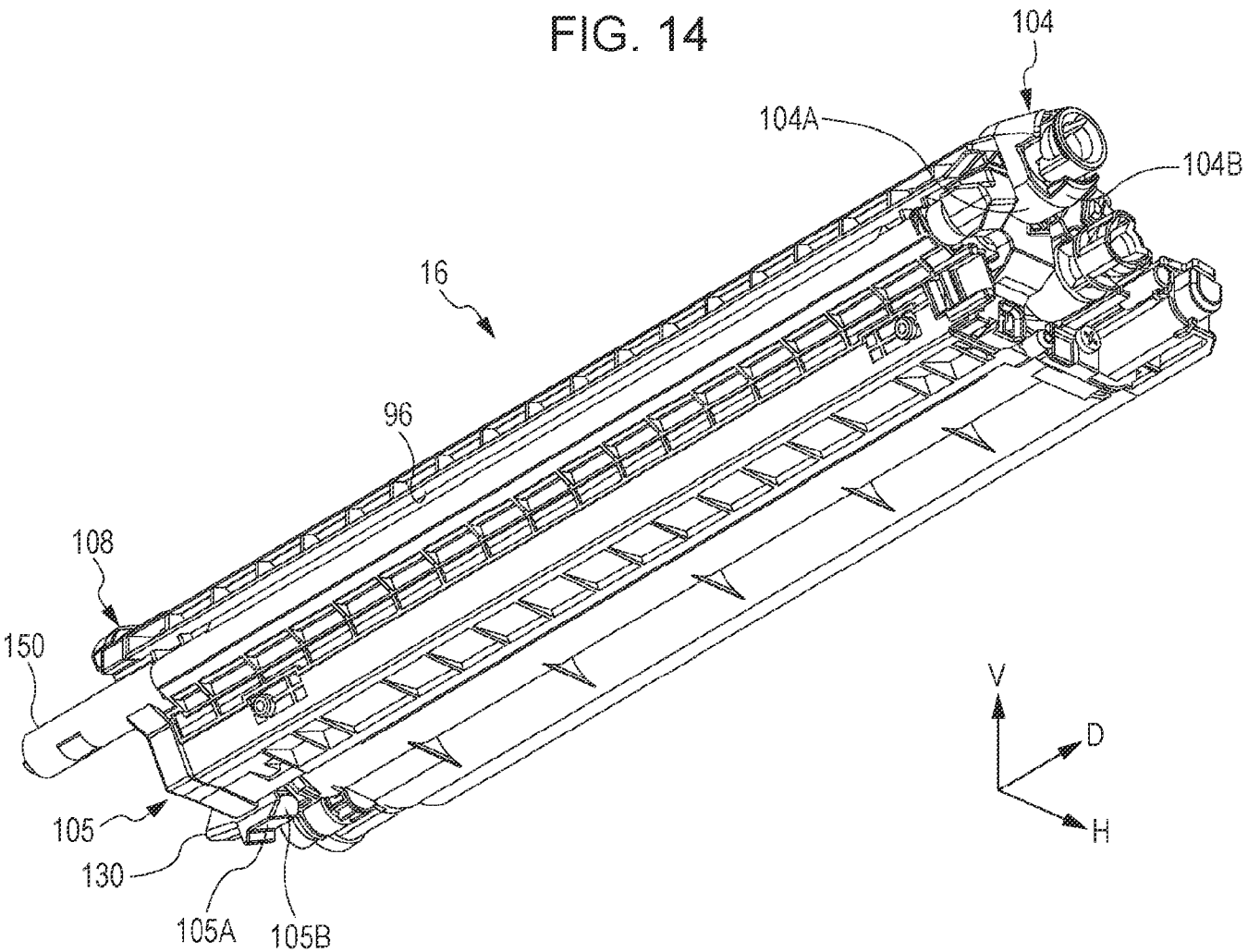
FIG. 14 is a perspective view showing the image forming unit provided in the image forming apparatus according to the exemplary embodiment of the present invention.
Figure 16:
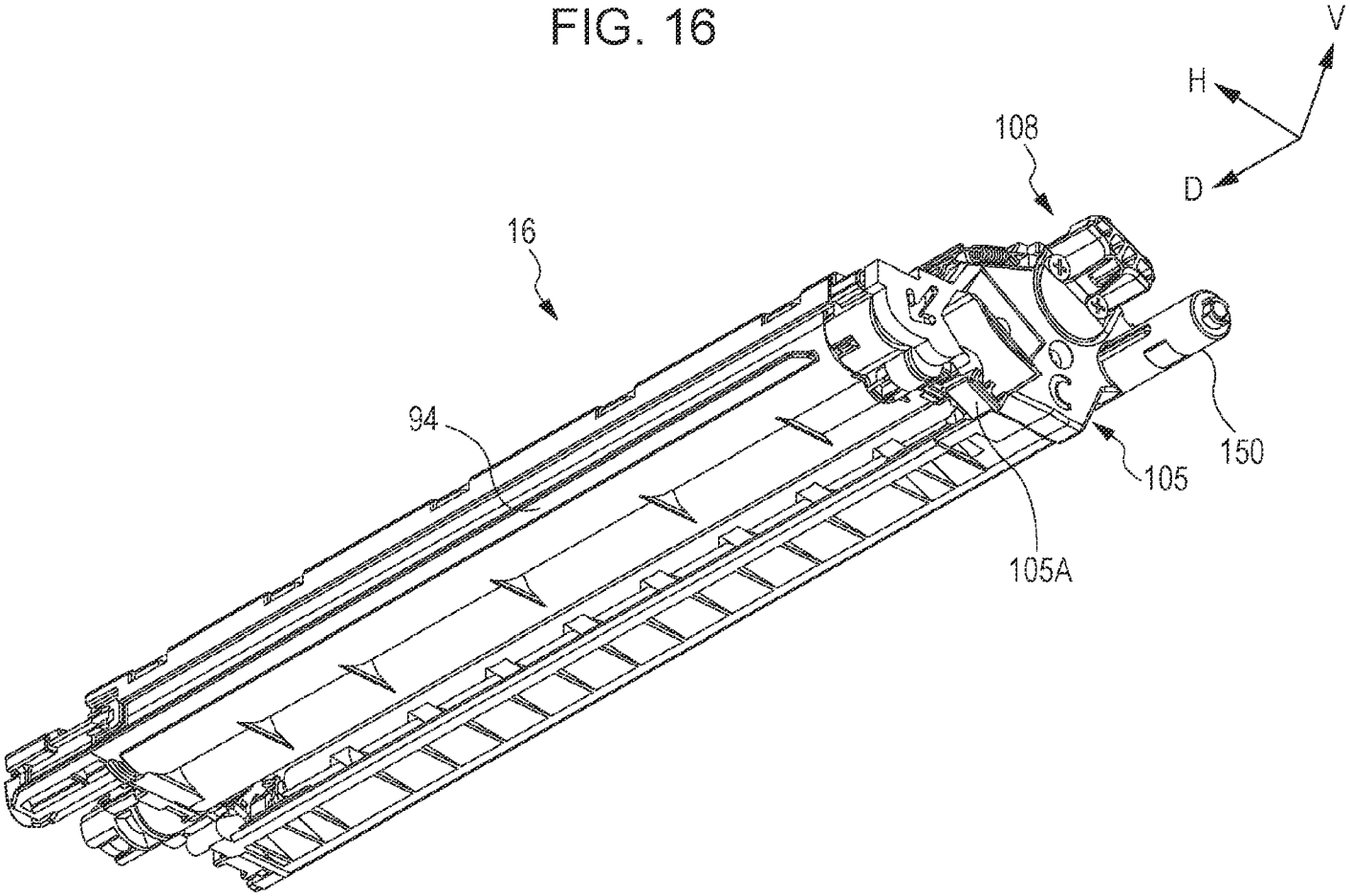
FIG. 16 is a perspective view showing the image forming unit provided in the image forming apparatus according to the exemplary embodiment of the present invention.

The image forming unit 16 is mountable to and removable from the apparatus body 10A by moving the image forming unit 16 in the direction of the rotational axis of the image holding member 34 (first direction, which is the same as the apparatus depth direction in the exemplary embodiment). As shown in FIGS. 14 and 16, a first sliding surface 94 and a second sliding surface 96 are formed on a housing of the image forming unit 16. The first and second sliding surfaces 94 and 96 are used to mount the image forming unit 16 to and remove the image forming unit 16 from the apparatus body 10A. The configuration etc. for mounting the image forming unit 16 to and removing the image forming unit 16 from the apparatus body 10A will be discussed in detail later.

[Exposure Device]

Next, the exposure device 14 will be described.

As shown in FIG. 19, a polygonal mirror 32 that is a rotatable multifaceted mirror is disposed inside a housing 14A of the exposure device 14. Laser light beams LB-Y, LB-M, LB-C, and LB-K emitted from a semiconductor laser 54 serving as an example of a light source are radiated onto the polygonal mirror 32 via a cylindrical lens (not shown), and deflected by the polygonal mirror 32 for scanning in a main scanning direction. The laser light LB-Y, LB-M, LB-C, and LB-K deflected by the polygonal mirror 32 scans from a location obliquely below to expose an exposure position on the image holding member 34 via an imaging lens and plural mirrors (not shown).

The exposure device 14 thus scans on the image holding member 34 from a location obliquely below for exposure. Therefore, foreign matter such as toner may fall onto the exposure device 14 from e.g. the developers 38 provided in the image forming units 16 for each color positioned above. Thus, transparent glass pieces 40Y, 40M, 40C, and 40K are provided on portions of the outer peripheral surface of the housing 14A that face upward. The transparent glass pieces 40Y, 40M, 40C, and 40K are made of transparent glass to transmit the four beams of laser light LB-Y, LB-M, LB-C, and LB-K, respectively, onto the image holding members 34 of the image forming units 16 for each color.

[First Transfer Unit and Second Transfer Roller]

Next, the first transfer unit 18 and the second transfer roller 22 will be described.

The first transfer unit 18 is disposed above the image forming units 16 for each color in the vertical direction. The first transfer unit 18 includes an endless intermediate transfer belt 42, a driving roller 46 that rotationally drives the intermediate transfer belt 42 wound around the driving roller 46 to circulate the intermediate transfer belt 42 in the direction of the arrow A, a tension application roller 48 that applies tension to the intermediate transfer belt 42 wound around the tension application roller 48, a driven roller 50 disposed above the tension application roller 48 in the vertical direction to be rotationally driven by the intermediate transfer belt 42, and first transfer rollers 52 disposed opposite to the image holding members 34 for each color, respectively, across the intermediate transfer belt 42.

Consequently, the toner images for each color including yellow (Y), magenta (M), cyan (C), and black (K) sequentially formed on the image holding members 34 of the image forming units 16 for each color are transferred in a multiplexed manner onto the intermediate transfer belt 42 by the first transfer rollers 52 for each color.

The first transfer unit 18 also includes a removal member 56 that contacts the outer peripheral surface of the intermediate transfer belt 42 to remove residual toner remaining on the outer peripheral surface of the image holding member 42.

The removal member 56 includes a removal blade 58 that contacts the intermediate transfer belt 42 to remove residual toner remaining on the intermediate transfer belt 42, and a transport auger 57 that transports the waste toner (residual toner) removed by the removal blade 58 and deposited in a housing 56A to a waste toner box 124 (see FIG. 8) to be discussed later.

Further, the second transfer roller 22 is provided opposite to the driven roller 50 across the intermediate transfer belt 42. The second transfer roller 22 transfers the toner images, which have been transferred to the intermediate transfer belt 42, onto the sheet member P being transported.

The toner image for each color including yellow (Y), magenta (M), cyan (C), and black (K) transferred to the intermediate transfer belt 42 in a multiplexed manner are thus transported by the intermediate transfer belt 42. The transported toner images are interposed between the driven roller 50 and the second transfer roller 22 to be subjected to a second transfer onto the sheet member P transported along the transport path 60 by the feed/transport unit 30 to be discussed later.

[Feed/Transport Unit]

Next, the feed/transport unit 30 that feeds and transports the sheet member P will be described.

The feed/transport unit 30 includes a paper feed member 62 disposed in the apparatus body 10A below the exposure device 14 in the vertical direction to be loaded with plural sheet members P.

The feed/transport unit 30 further includes a paper feed roller 64 that feeds the sheet members P charged in the paper feed member 62 to the transport path 60, a separation roller 66 that separates the sheet members P fed to the paper feed roller 64 from each other, and an alignment roller 68 that adjusts the timing of transport of the sheet members P. The rollers are disposed in the order in which they are mentioned from the upstream side toward the downstream side in the direction of transport of the sheet members P.

With this configuration, the sheet members P fed from the paper feed member 62 are fed to a position (second transfer position) of contact between the intermediate transfer belt 42 and the second transfer roller 22 by the rotating alignment roller 68 at predetermined timings.

The feed/transport unit 30 further includes a double-side transport device 70 used to form toner images on the other surface of the sheet member P, to one surface of which the toner images have been fixed by the fixing device 24, without directly ejecting the sheet member P to the ejection section 26 through the ejection roller 28.

The double-side transport device 70 includes a double-side transport path 72 through which the sheet member P is transported from the ejection roller 28 toward the alignment roller 68 with the front and back sides of the sheet member P reversed, and transport rollers 74 and 76 provided along the double-side transport path 72 to transport the sheet member P.

(Function of Overall Configuration)

With the configuration described above, an image is formed on the sheet member P as follows.

First, tone data for each color are sequentially output from the image processing section 12 to the exposure device 14. Laser light LB-Y, LB-M, LB-C, and LB-K emitted from the exposure device 14 in accordance with the tone data scans the outer peripheral surface of the image holding member 34 charged by the charging member 36 for exposure (in the main scanning direction). Consequently, an electrostatic latent image is formed on the outer peripheral surface of the image holding member 34. The electrostatic latent image formed on the image holding member 34 is developed by the developer 38 for each color to be visualized as a toner image for each color including yellow (Y), magenta (M), cyan (C), and black (K).

Further, the toner images for each color including yellow (Y), magenta (M), cyan (C), and black (K) formed on the image holding members 34 are transferred in a multiplexed manner onto the circulating intermediate transfer belt 42 by the first transfer rollers 52 of the first transfer unit 18.

The toner images for each color transferred in a multiplexed manner to the circulating intermediate transfer belt 42 are subjected to a second transfer performed by the second transfer roller 22 onto the sheet member P transported from the paper feed member 62 along the transport path 60 by the paper feed roller 64, the separation roller 66, and the alignment roller 68.

Further, the sheet member P to which the toner images have been transferred is transported to the fixing device 24. Then, the toner images are fixed to the sheet member P by the fixing device 24. The sheet member P to which the toner images have been fixed is ejected to the ejection section 26 by the ejection roller 28.

In the case where an image is to be formed on both surfaces of the sheet member P, the sheet member P, to one side (front surface) of which the toner images have been fixed by the fixing device 24, is not directly ejected to the ejection section 26 by the ejection roller 28. The direction of transport of the sheet member P is changed by reversing the rotation of the ejection roller 28. Then, the sheet member P is transported along the double-side transport path 72 by the transport rollers 74 and 76.

The sheet member P transported along the double-side transport path 72 is transported again to the alignment roller 68 with the front and back sides of the sheet member P reversed. At this time, the toner images are transferred and fixed to the other surface (back surface) of the sheet member P. Thereafter, the sheet member P is ejected to the ejection section 26 by the ejection roller 28.

(Construction for Mounting and Removal)

Next, the construction etc. for mounting and removal of the image forming units 16 and the waste toner box 124 with respect to the apparatus body 10A will be described.

[Image Forming Units]

Figure 15:
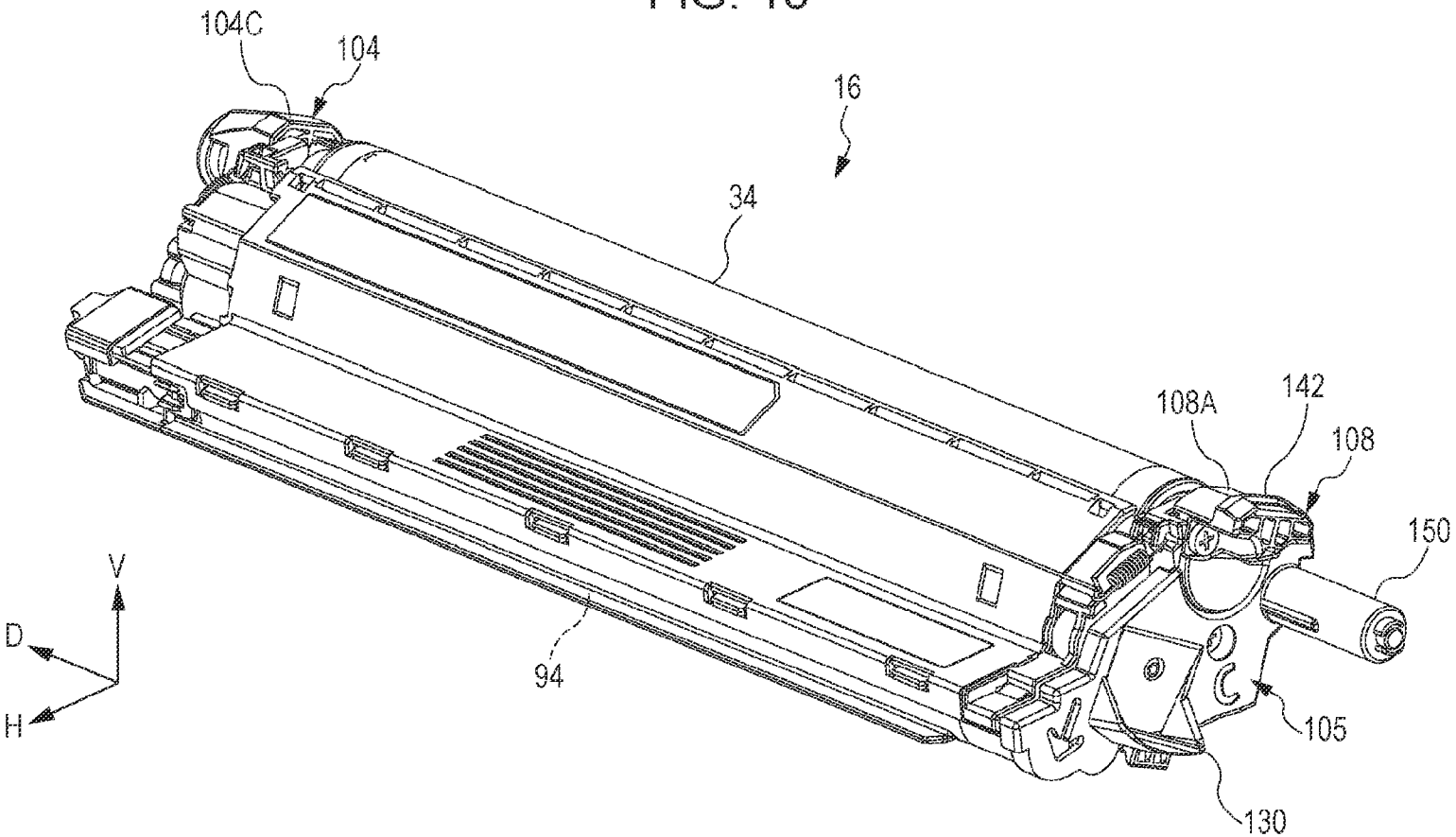
FIG. 15 is a perspective view showing the image forming unit provided in the image forming apparatus according to the exemplary embodiment of the present invention.

As shown in FIG. 15, the image forming unit 16 extends in the direction of the rotational axis of the image holding member 34 (an example of a first direction, which may be hereinafter simply referred to as "holding member axial direction"). A cylindrical discharge pipe 150 is formed on one end side of the image forming unit 16 in the longitudinal direction (on the apparatus front side to be discussed later) to extend in the holding member axial direction. The discharge pipe 150 is used to discharge waste toner in the image forming unit 16 to the outside. In the exemplary embodiment, the holding member axial direction and the apparatus depth direction are the same as each other. That is, the arrow D in the drawing indicates the holding member axial direction and the apparatus depth direction.

Figure 17:
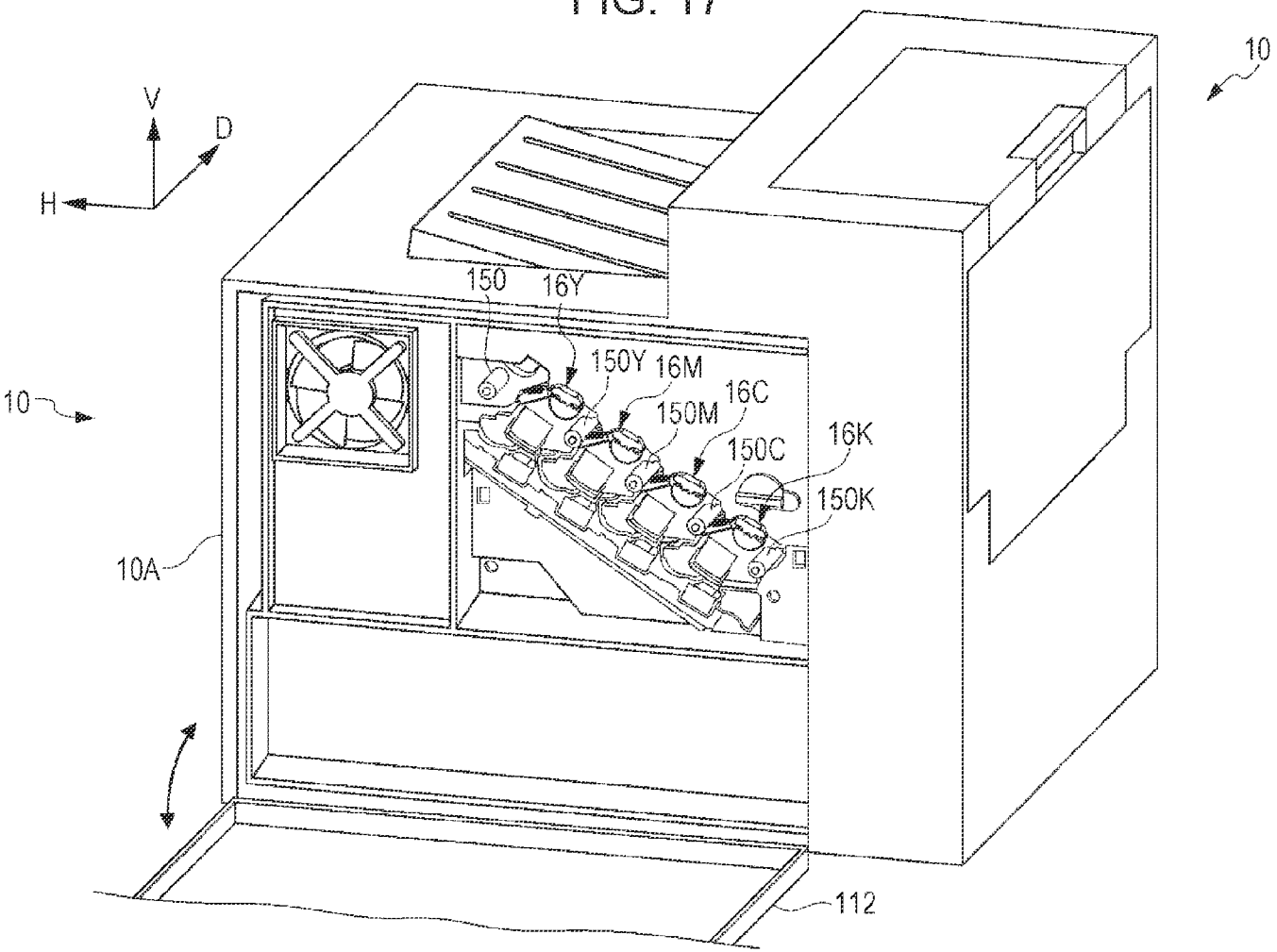
FIG. 17 is a perspective view showing the image forming apparatus according to the exemplary embodiment of the present invention.

As shown in FIG. 17, the apparatus body 10A includes a maintenance cover 112 that opens the front side of the image forming apparatus 10. With the waste toner box 124 to be discussed later removed from the apparatus body 10A, the image forming units 16 for each color are exposed to the outside (see FIG. 13). The image forming units 16 for each color mounted to the apparatus body 10A are disposed at intervals in a direction inclined with respect to the horizontal direction. In this state, the discharge pipes 150 are disposed on the front side of the apparatus body 10A (which may be hereinafter simply referred to as "apparatus front side").

The image forming unit 16 is removed from the apparatus body 10A by pulling the image forming unit 16 toward the apparatus front side in the holding member axial direction. Meanwhile, the image forming unit 16 is mounted to the apparatus body 10A by pushing the image forming unit 16 toward the back side of the apparatus body 10A (which may be hereinafter simply referred to as "apparatus back side") in the holding member axial direction. That is, the image forming unit 16 is mountable to and removable from the apparatus body 10A by moving the image forming unit 16 in the holding member axial direction.

[Guiding Surfaces and Sliding Surfaces]

Next, a first guiding surface 82 and a second guiding surface 84 that guide the image forming unit 16 when mounting and removing the image forming unit 16 with respect to the apparatus body 10A and a first sliding surface 94 and a second sliding surface 96 formed on the image forming unit 16 to slide over the guiding surfaces 82 and 84, respectively, will be described.

[Guiding Surfaces]

Figure 12A:
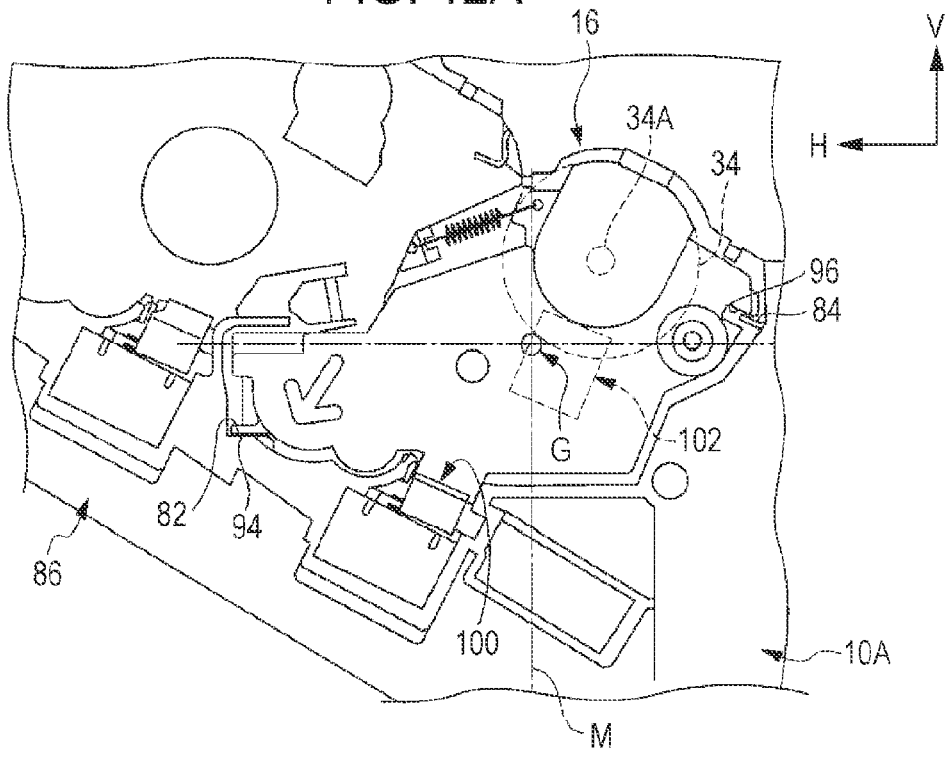
FIGS. 12A and 12B are each an enlarged front view showing the image forming unit etc. provided in the image forming apparatus according to the exemplary embodiment of the present invention.
Figure 12B:
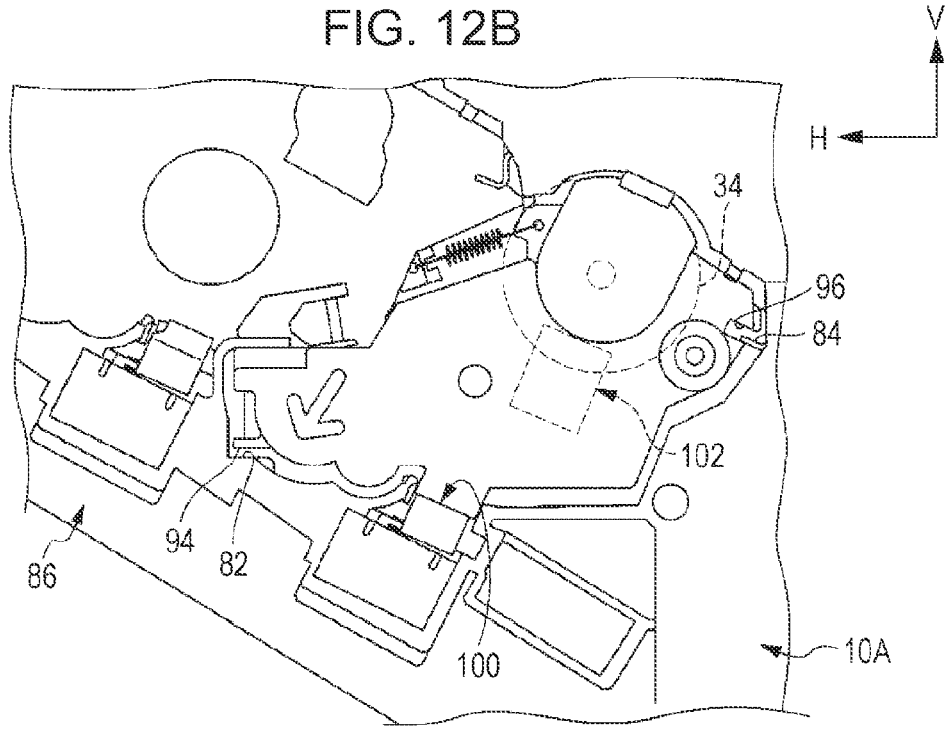
Figure 13:
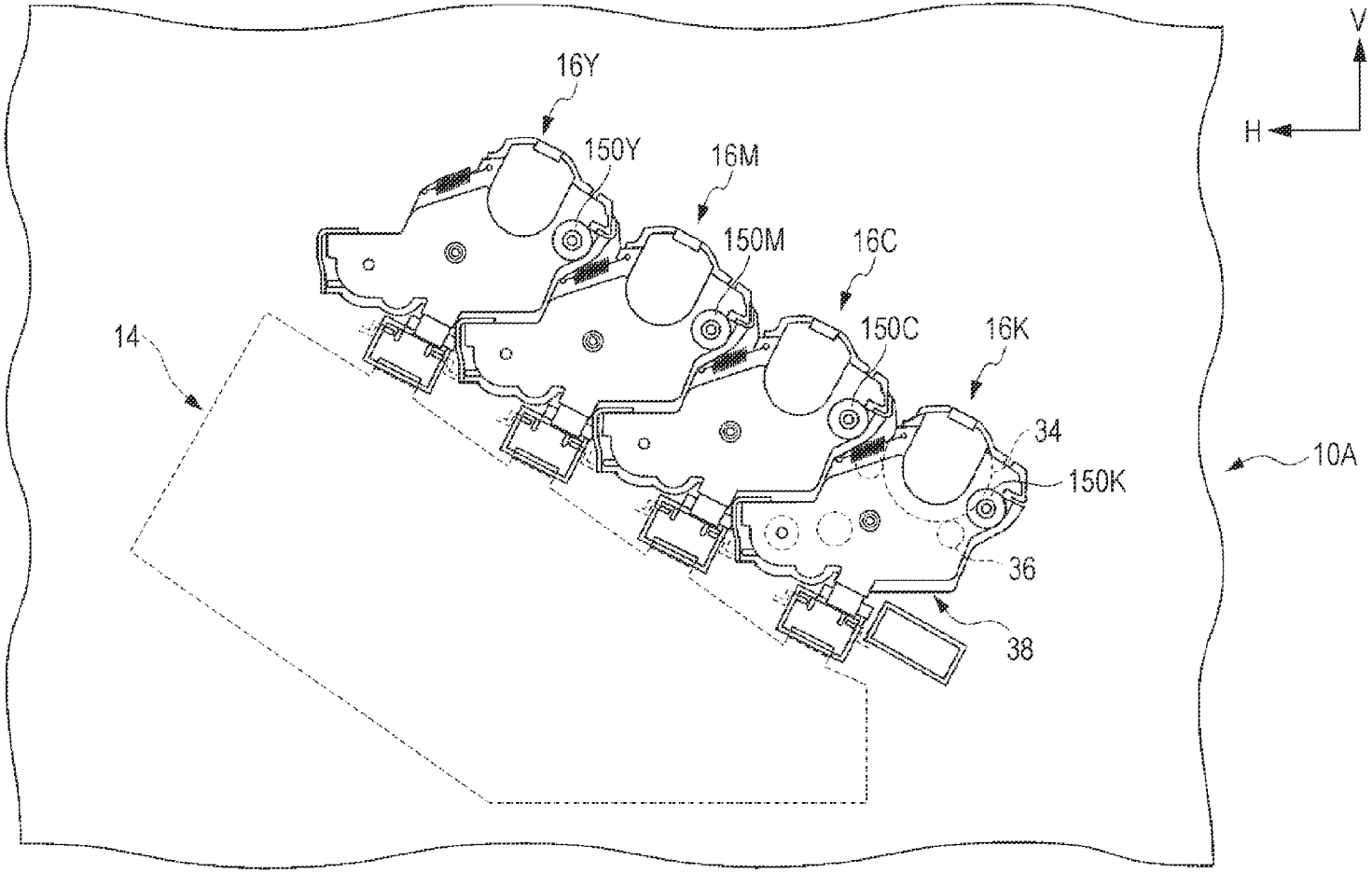
FIG. 13 is a front view showing the image forming units etc. provided in the image forming apparatus according to the exemplary embodiment of the present invention.

FIG. 12A is a front view showing a state in which the image forming unit 16 has been moved in the holding member axial direction to be mounted to and removed from the apparatus body 10A. FIG. 12B is a front view showing a state in which the image forming unit 16 has been mounted to the apparatus body 10A (disposed at a mounting position).

As shown in FIG. 12A, the first guiding surface 82 and the second guiding surface 84 are formed on the apparatus body 10A to extend in the holding member axial direction. The first guiding surface 82 and the second guiding surface 84 guide the image forming unit 16 when the image forming unit 16 is mounted to and removed from the image forming unit 16. The first guiding surface 82 is disposed on one side (left side in FIG. 12), in the horizontal direction, of the image forming unit 16 as seen in the holding member axial direction. The second guiding surface 84 is disposed on the other side (right side in FIG. 12), in the horizontal direction, of the image forming unit 16 as seen in the holding member axial direction. That is, the first guiding surface 82 and the second guiding surface 84 are disposed with a vertical line M that passes through the center of gravity G of the image forming unit 16 interposed between the first and second guiding surfaces 82 and 84 as seen in the holding member axial direction.

[Sliding Surfaces]

As shown in FIGS. 12A and 16, the first sliding surface 94 that slides over the first guiding surface 82 in mounting the image forming unit 16 to and removing the image forming unit 16 from the apparatus body 10A is formed on the image forming unit 16. The first sliding surface 94 extends in the holding member axial direction along the first guiding surface 82.

In contrast, as shown in FIGS. 12A and 14, the second sliding surface 96 that slides over the second guiding surface 84 in mounting the image forming unit 16 to and removing the image forming unit 16 from the apparatus body 10A is formed on the image forming unit 16. The second sliding surface 96 extends in the holding member axial direction along the second guiding surface 84.

[Plate Springs]

Next, plate springs 100 and 102 serving as an example of a moving member that moves the image forming unit 16, which is pushed into the apparatus body 10A in mounting the image forming unit 16 to the apparatus body 10A, in a direction (vertical direction, which is an example of a second direction) intersecting the holding member axial direction to urge the image forming unit 16 toward the mounting position with respect to the apparatus body 10A will be described. The term "mounting position" refers to a position at which the image forming unit 16 is finally mounted to the apparatus body 10A, and corresponds to the position of the image forming unit 16 in FIGS. 4 and 12B.

Figure 4:
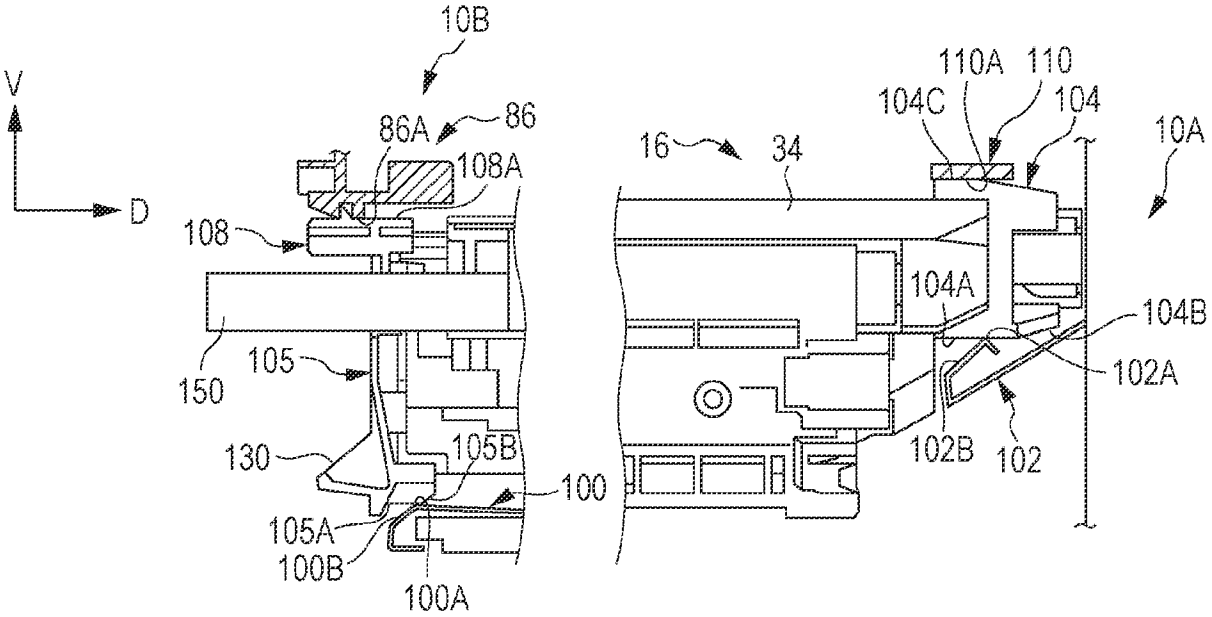
FIG. 4 is a cross-sectional view showing the image forming unit etc. provided in the image forming apparatus according to the exemplary embodiment of the present invention.

As shown in FIG. 4, the plate spring 100 is disposed on the apparatus front side in the apparatus body 10A, and the plate spring 102 is disposed on the apparatus back side in the apparatus body 10A.

The plate spring 100 is fixed to the apparatus body 10A on the apparatus back side, and includes a bent portion 100A that contacts the image forming unit 16 with the image forming unit 16 mounted to the apparatus body 10A (disposed at the mounting position), and an inclined surface 100B formed on the apparatus front side with respect to the bent portion 100A to face upward. The inclined surface 100B is inclined downward in the vertical direction toward the apparatus front side.

Meanwhile, as shown in FIGS. 4 and 16, the image forming unit 16 includes a cover member 105 provided on the apparatus front side. The cover member 105 includes a contact surface 105A that faces downward to contact the bent portion 100A with the image forming unit 16 mounted to the apparatus body 10A (disposed at the mounting position), and an inclined surface 105B formed on the apparatus back side with respect to the contact surface 105A. The contact surface 105A is formed to extend in the holding member axial direction. The inclined surface 105B is inclined upward in the vertical direction toward the apparatus back side.

Meanwhile, as shown in FIG. 4, the plate spring 102 is fixed to the apparatus body 10A, and includes a bent portion 102A that contacts the image forming unit 16 with the image forming unit 16 mounted to the apparatus body 10A (disposed at the mounting position), and an inclined surface 102B formed on the apparatus front side with respect to the bent portion 102A. The inclined surface 102B is inclined downward in the vertical direction toward the apparatus front side.

In contrast, as shown in FIGS. 4 and 14, the image forming unit 16 includes a bearing member 104 provided on the apparatus back side to rotatably support the image holding member 34. The bearing member 104 includes a contact surface 104A that contacts the bent portion 102A with the image forming unit 16 mounted to the apparatus body 10A (disposed at the mounting position), and an inclined surface 104B formed on the apparatus back side with respect to the contact surface 104A. The contact surface 104A is formed to extend in the holding member axial direction. The inclined surface 104B is inclined upward in the vertical direction toward the apparatus back side.

Figure 2A:
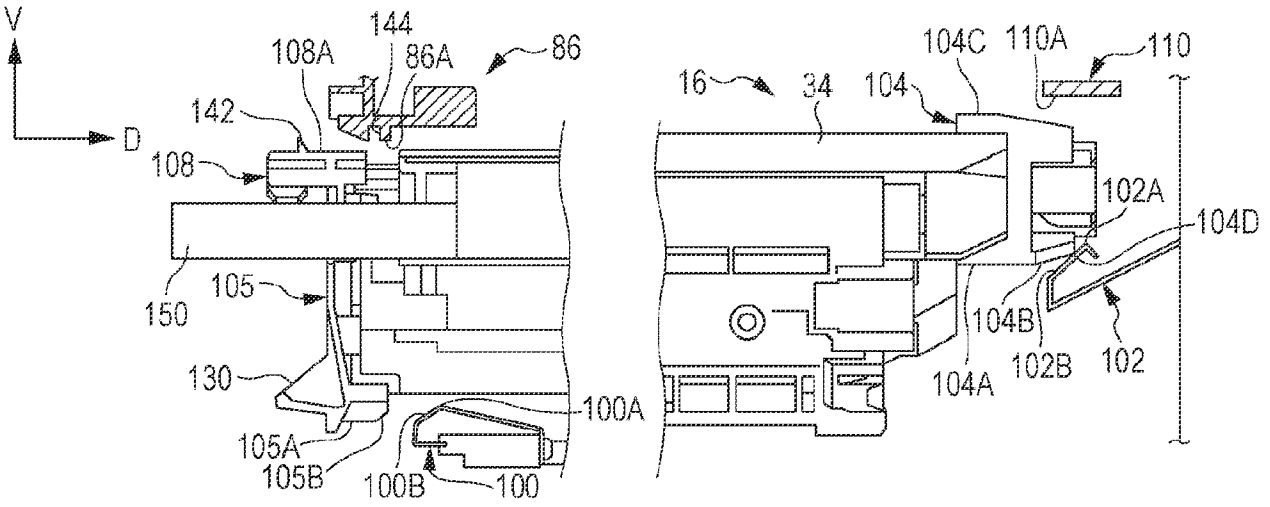
FIGS. 2A and 2B are each a cross-sectional view showing the image forming unit etc. provided in the image forming apparatus according to the exemplary embodiment of the present invention.
Figure 2B:
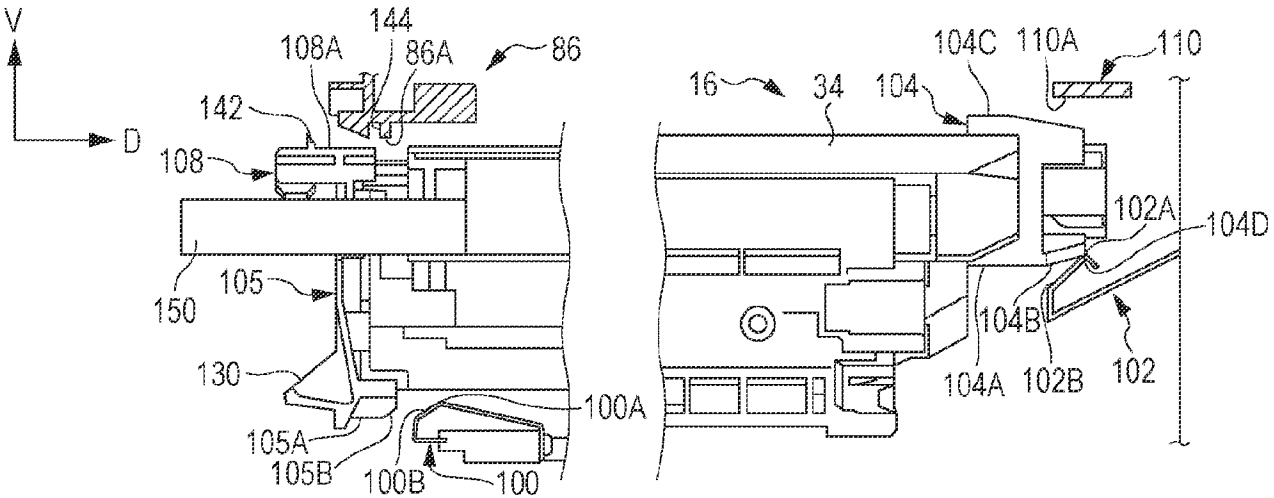
Figure 3A:
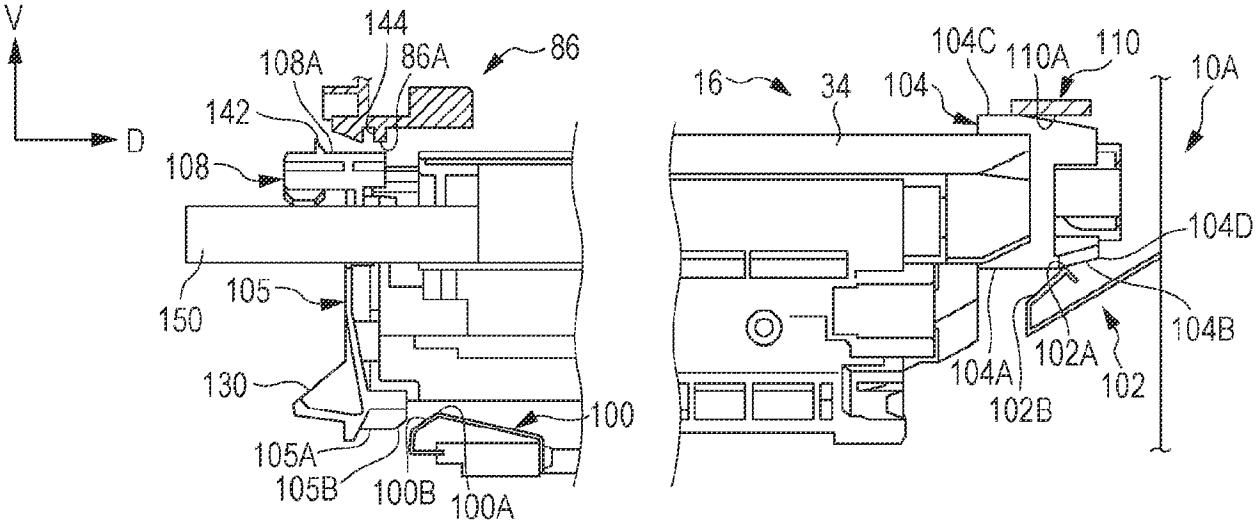
FIGS. 3A and 3B are each a cross-sectional view showing the image forming unit etc. provided in the image forming apparatus according to the exemplary embodiment of the present invention.

In the configuration, in order to mount the image forming unit 16 to the apparatus body 10A, the image forming unit 16 is pushed with respect to the apparatus body 10A toward the apparatus back side in the holding member axial direction. Then, first, as shown in FIG. 2A, an end portion 104D of the bearing member 104 contacts the inclined surface 102B of the plate spring 102. Next, as shown in FIGS. 2B and 3A, the end portion 104D and the inclined surface 104B of the bearing member 104 push the plate spring 102 to warp the plate spring 102 downward, and a portion of the image forming unit 16 on the apparatus back side is moved toward the mounting position by the urging force of the plate spring 102.

Figure 3B:
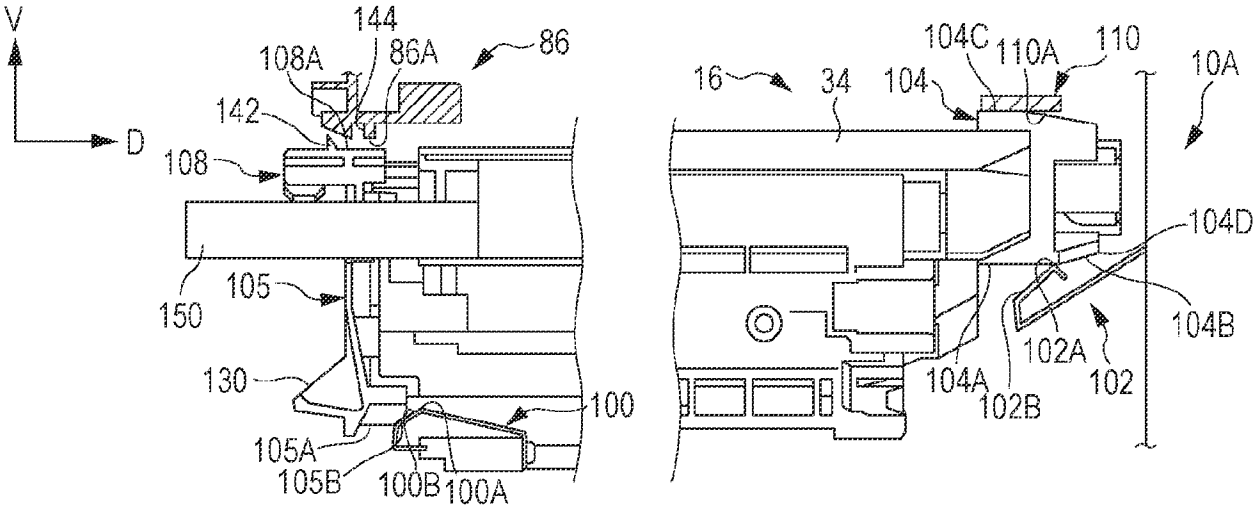

Further, as shown in FIG. 3B, the contact surface 104A of the bearing member 104 reaches the bent portion 102A of the plate spring 102. With the inclined surface 104B in contact with the plate spring 102, the image forming unit 16 is pushed back toward the apparatus front side by the urging force of the plate spring 102.

After the contact surface 104A reaches the bent portion 102A, the inclined surface 105B of the cover member 105 contacts the plate spring 100. In addition, as shown in FIGS. 3B and 4, the inclined surface 105B of the cover member 105 pushes the plate spring 100 to warp the plate spring 100 downward, and a portion of the image forming unit 16 on the apparatus front side is moved toward the mounting position by the urging force of the plate spring 100. Further, the contact surface 105A of the cover member 105 reaches the bent portion 100A of the plate spring 100. With the inclined surface 105B in contact with the plate spring 100, the image forming unit 16 is pushed back toward the apparatus front side by the urging force of the plate spring 100.

[Positioning Structure]

Next, a positioning structure for positioning the image forming unit 16 at the mounting position will be described.

As shown in FIG. 4, the apparatus body 10A includes a frame member 86 disposed opposite to the plate spring 100 across the image forming unit 16. The frame member 86 includes a positioning surface 86A (see FIG. 5) formed to face toward the plate spring 100.

In addition, as shown in FIGS. 4 and 15, the image forming unit 16 includes a bearing member 108 provided on the apparatus front side to rotatably support the image holding member 34. The bearing member 108 includes a contact surface 108A that contacts the positioning surface 86A with the image forming unit 16 mounted to the apparatus body 10A (disposed at the mounting position) to determine the position of the image forming unit 16 on the apparatus front side.

Meanwhile, as shown in FIG. 4, the apparatus body 10A includes a positioning member 110 provided opposite to the plate spring 102 across the image forming unit 16. The positioning member 110 is fixed to a frame member (not shown), and includes a positioning surface 110A formed to face toward the plate spring 102.

In contrast, as shown in FIGS. 4 and 15, the bearing member 104 includes a contact surface 104C that contacts the positioning surface 110A with the image forming unit 16 mounted to the apparatus body 10A (disposed at the mounting position) to determine the position of the image forming unit 16 on the apparatus front side in the vertical direction.

[Restriction Section]

Next, a restriction section 140 serving as an example of a restriction member that restricts movement of the image forming unit 16 disposed at the mounting position to the removal side in the holding member axial direction will be described.

Figure 5:
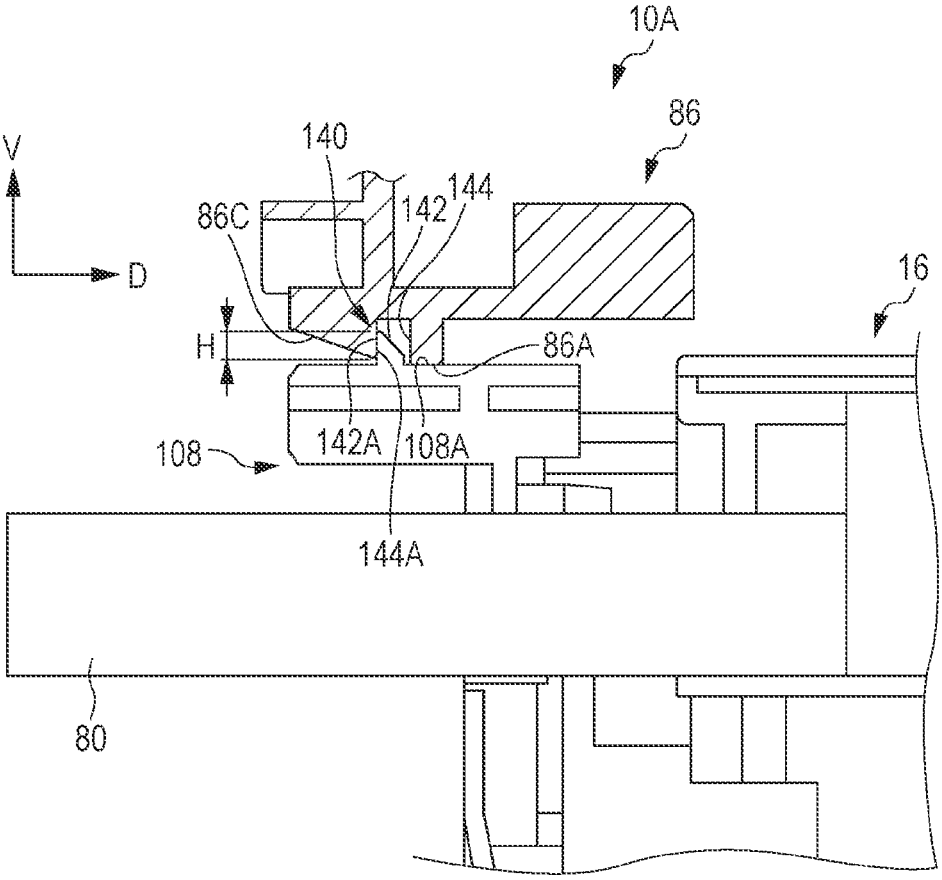
FIG. 5 is an enlarged cross-sectional view showing the image forming unit etc. provided in the image forming apparatus according to the exemplary embodiment of the present invention.

As shown in FIGS. 5 and 15, a projecting portion 142 that projects from the contact surface 108A is formed on a portion of the contact surface 108A of the bearing member 108 on the apparatus front side.

In contrast, a recessed portion 144 is formed in a portion of the positioning surface 86A of the frame member 86 on the apparatus front side. The projecting portion 142 of the image forming unit 16 disposed at the mounting position is inserted into the recessed portion 144 to restrict movement of the image forming unit 16 in the holding member axial direction. More particularly, the projecting portion 142 is formed to include a wall 142A serving as an example of a first wall that faces toward the removal side of the image forming unit 16 in the holding member axial direction. Meanwhile, the recessed portion 144 is formed to include a wall 144A serving as a contact portion that contacts the wall 142A from the removal side of the image forming unit 16 in the holding member axial direction with the image forming unit 16 mounted to the apparatus body 10A (disposed at the mounting position).

Thus, the restriction section 140 that restricts movement of the image forming unit 16 toward the removal side in the holding member axial direction is formed to include the wall 142A and the wall 144A, and the wall 142A contacts the wall 144A when the image forming unit 16 is to be moved toward the removal side in the holding member axial direction. The wall 142A may come into contact with the wall 144A as a result of movement of the image forming unit 16, or may already be in contact with the wall 144A when movement of the image forming unit 16 is started.

An inclined surface 86C that contacts the projecting portion 142 when the image forming unit 16 is mounted to the apparatus body 10A is formed on a portion of the recessed portion 144 of the frame member 86 on the apparatus front side.

[Discharge Pipe]

Next, the discharge pipe 150 will be described. The discharge pipe 150 is used to transport residual toner removed from the image holding member 34 by the removal blade 80 of the removal member 78 provided in each image forming unit 16 and residual toner removed from the intermediate transfer belt 42 by the removal blade 58 of the removal member 56 provided in the first transfer unit 18 to the waste toner box 124 to be discussed later.

Figure 11:
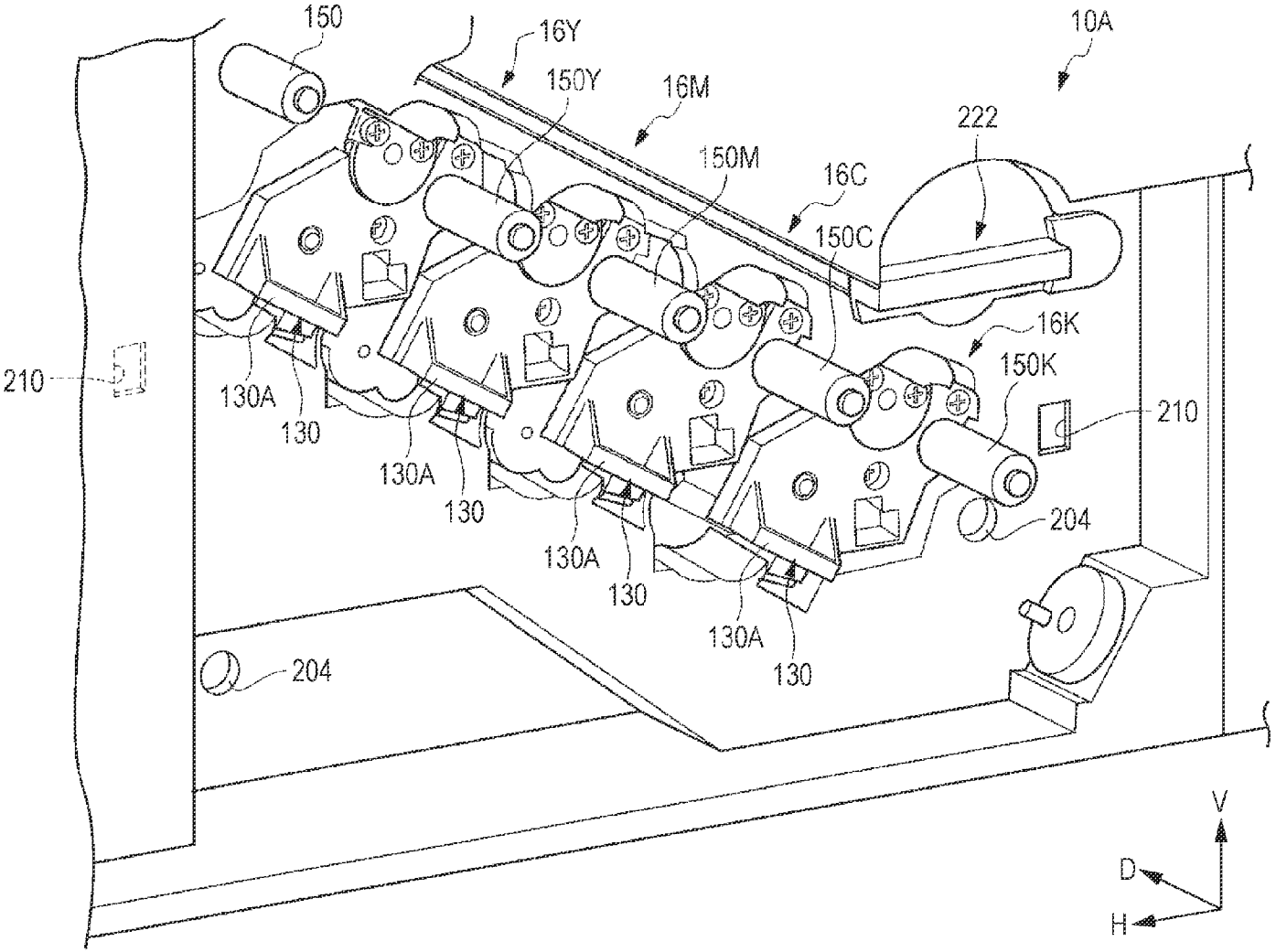
FIG. 11 is a perspective view showing the image forming units etc. provided in the image forming apparatus according to the exemplary embodiment of the present invention, showing a state in which the image forming units are mounted to an apparatus body.

The image forming units 16 and the apparatus body 10A each include a cylindrical discharge pipe 150 used to transport residual toner removed by the removal member 78 and the removal member 56 and extending toward the apparatus front side in the apparatus depth direction as shown in FIG. 11.

The inside of the discharge pipe 150 communicates with the inside of the removal member 78 or the removal member 56 so that residual toner removed by the removal member 78 or the removal member 56 may flow into the discharge pipe 150.

Figure 6:
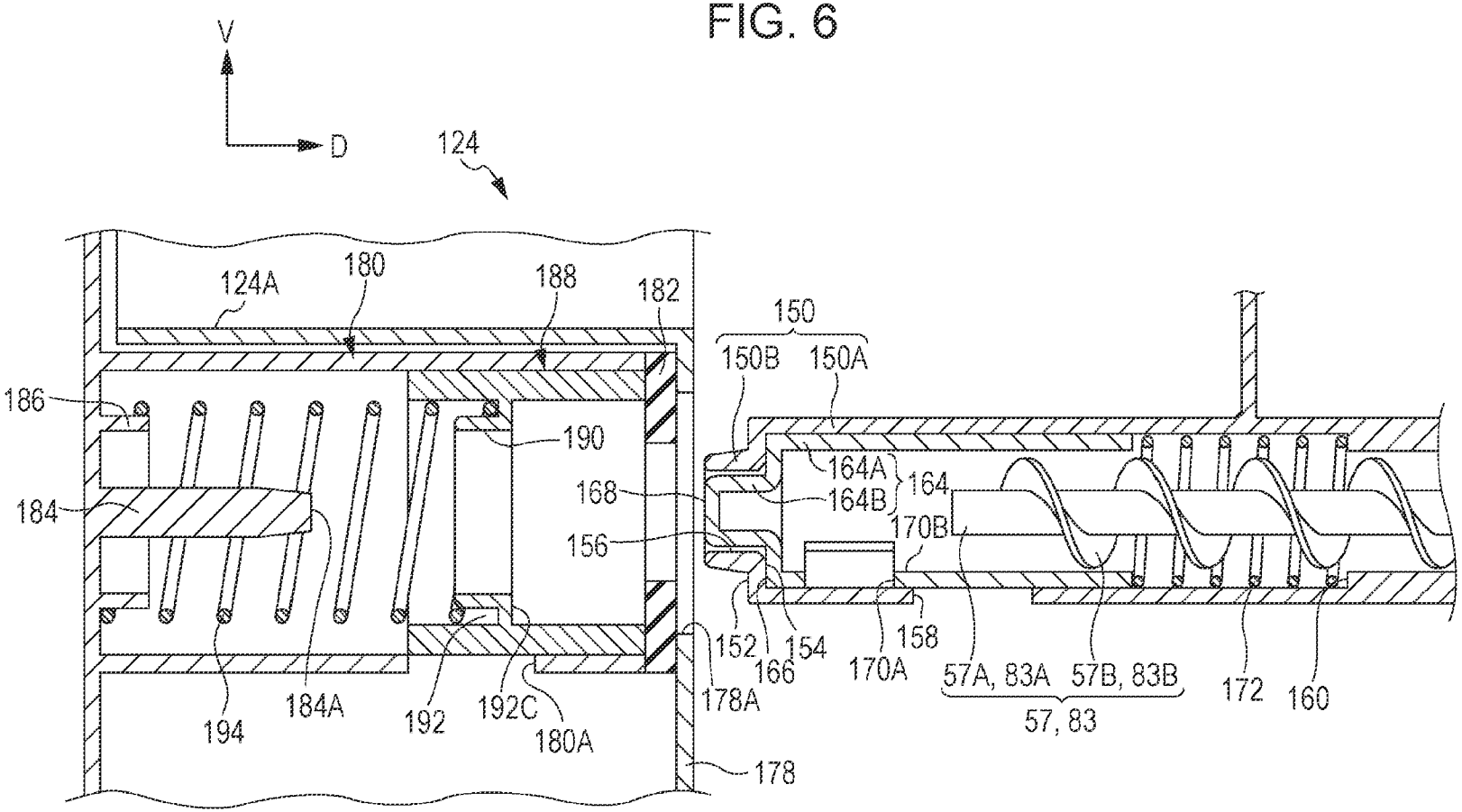
FIG. 6 is an enlarged cross-sectional view showing an ejection pipe of the image forming unit and an opening in a waste toner box provided in the image forming apparatus according to the exemplary embodiment of the present invention.
Figure 7:
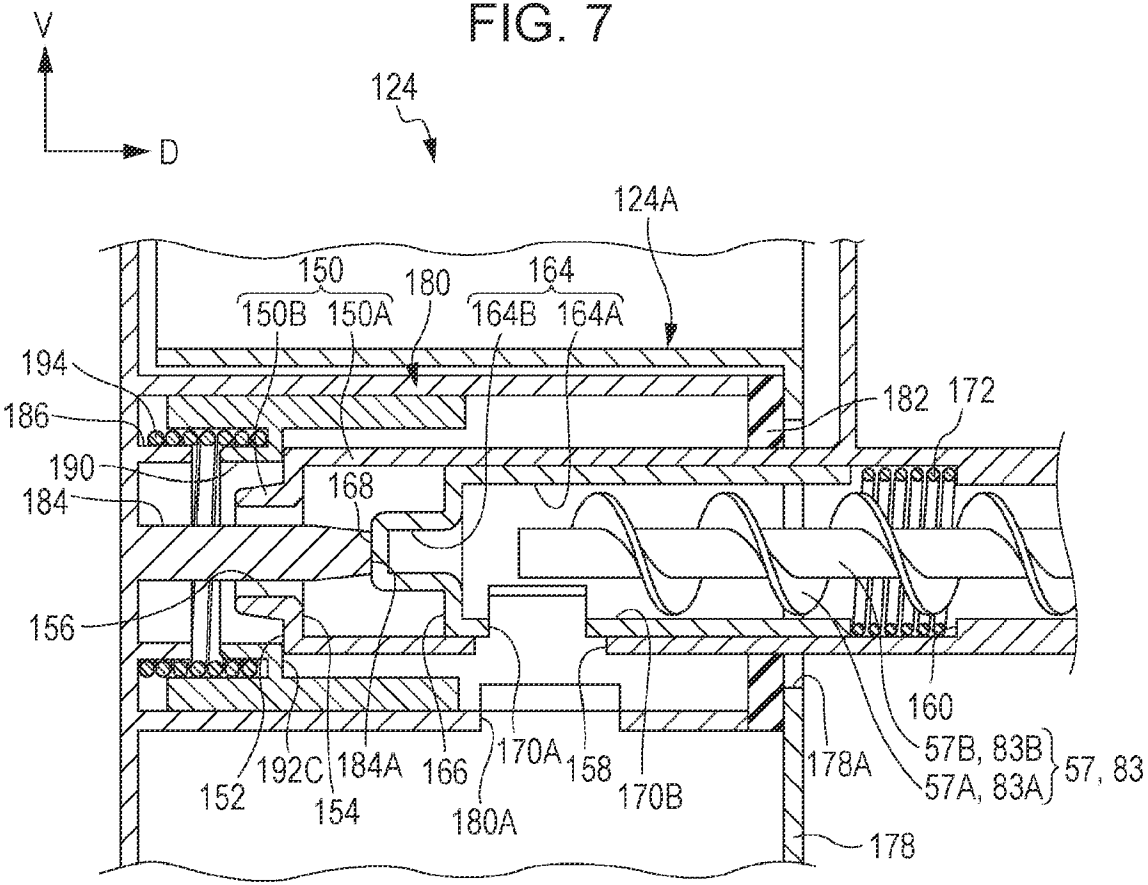
FIG. 7 is an enlarged cross-sectional view showing the ejection pipe of the image forming unit and the opening in the waste toner box provided in the image forming apparatus according to the exemplary embodiment of the present invention.

As shown in FIGS. 6 and 7, the transport auger 57, 83 extends along the holding member axial direction, and a portion of the transport auger 57, 83 on the apparatus front side is disposed inside the discharge pipe 150. The transport auger 57, 83 includes a rotary shaft 57A, 83A that is rotatable, and a spiral member 57B, 83B provided spirally around the rotary shaft 57A, 83A.

The rotary shaft 57A, 83A is supported by a support member (not shown), and rotated in response to a rotational force from a motor (not shown). Then, the spiral member 57B, 83B is driven by rotation of the rotary shaft 57A, 83A to transport residual toner (waste toner) removed from the image holding member 34 for each color and the intermediate transfer belt 42 toward the discharge pipe 150.

The discharge pipe 150 includes a large-diameter portion 150A and a small-diameter portion 150B formed coaxially with the large-diameter portion 150A and formed integrally with the distal end portion (end portion on the apparatus front side) of the large-diameter portion 150A. A pressing surface 152 is formed at the distal end portion of the large-diameter portion 150A, and formed to be annular on the radially outer side of the small-diameter portion 150B. The pressing surface 152 faces toward the apparatus front side to push a pushed surface 192C of a shutter 188 to be discussed later.

A surface (inner surface that faces toward the apparatus back side) of the discharge pipe 150 opposite to the pressing surface 152 serves as a restricting surface 154 that contacts a restricted surface 166 of an open/close pipe 164 to be discussed later to restrict movement of the open/close pipe 164.

An insertion hole 156 is formed in the small-diameter portion 150B. The insertion hole 156 penetrates through the small-diameter portion 150B in the axial direction for insertion of a small-diameter portion 164B or a projecting portion 184 to be discussed later.

A discharge port 158 is formed on the lower side, in the vertical direction, of an intermediate portion of the large-diameter portion 150A in the apparatus depth direction. The discharge port 158 discharges waste toner in the large-diameter portion 150A to the outside of the large-diameter portion 150A. Further, an annular thickened surface 160 that is thickened radially inward and that faces toward the apparatus front side is formed on an inner wall of the large-diameter portion 150A on the apparatus back side with respect to the discharge port 158.

An open/close pipe 164 that opens and closes the discharge port 158 is disposed inside the discharge pipe 150 along the inner peripheral wall of the discharge pipe 150.

The open/close pipe 164 is relatively movable with respect to the discharge pipe 150 in the apparatus depth direction. The open/close pipe 164 includes a large-diameter portion 164A and a small-diameter portion 164B formed coaxially with the large-diameter portion 164A and formed integrally with the distal end portion (end portion on the apparatus front side) of the large-diameter portion 164A.

A restricted surface 166 is formed at the distal end portion of the large-diameter portion 164A, and formed to be annular on the radially outer side of the small-diameter portion 164B. The restricted surface 166 contacts the restricting surface 154 of the discharge pipe 150, which restricts movement of the open/close pipe 164.

The small-diameter portion 164B is inserted into the insertion hole 156 of the discharge pipe 150. A distal end surface 168 of the small-diameter portion 164B serves as a surface to be pushed by a distal end 184A of a projecting portion 184 to be discussed later.

An opening port 170A is formed on the lower side, in the vertical direction, of a pipe wall of the large-diameter portion 164A on the distal end side. The opening port 170A penetrates through the pipe wall of the large-diameter portion 164A to open the discharge port 158 of the discharge pipe 150. In contrast, a part of the pipe wall of the open/close pipe 164 on the base end side with respect to the opening port 170A serves as a closing portion 170B that closes the discharge port 158 of the discharge pipe 150.

The open/close pipe 164 is movable between a closing position (see FIG. 6) at which the closing portion 170B closes the discharge port 158 of the discharge pipe 150 with the restricted surface 166 in contact with the restricting surface 154 of the discharge pipe 150 for restriction of movement, and an opening position (see FIG. 7) at which the opening port 170A opens the discharge port 158 of the discharge pipe 150.

Further, a compression coil spring 172 is disposed between the rear end of the large-diameter portion 164A of the open/close pipe 164 and the thickened surface 160 of the large-diameter portion 150A of the discharge pipe 150 to urge the open/close pipe 164 toward the closing position.

[Waste Toner Box]

Next, the waste toner box 124 serving as an example of a suppression member that collects waste toner (residual toner) discharged to the outside from the image forming unit 16 or the apparatus body 10A through the discharge pipe 150 will be described.

Figure 18:
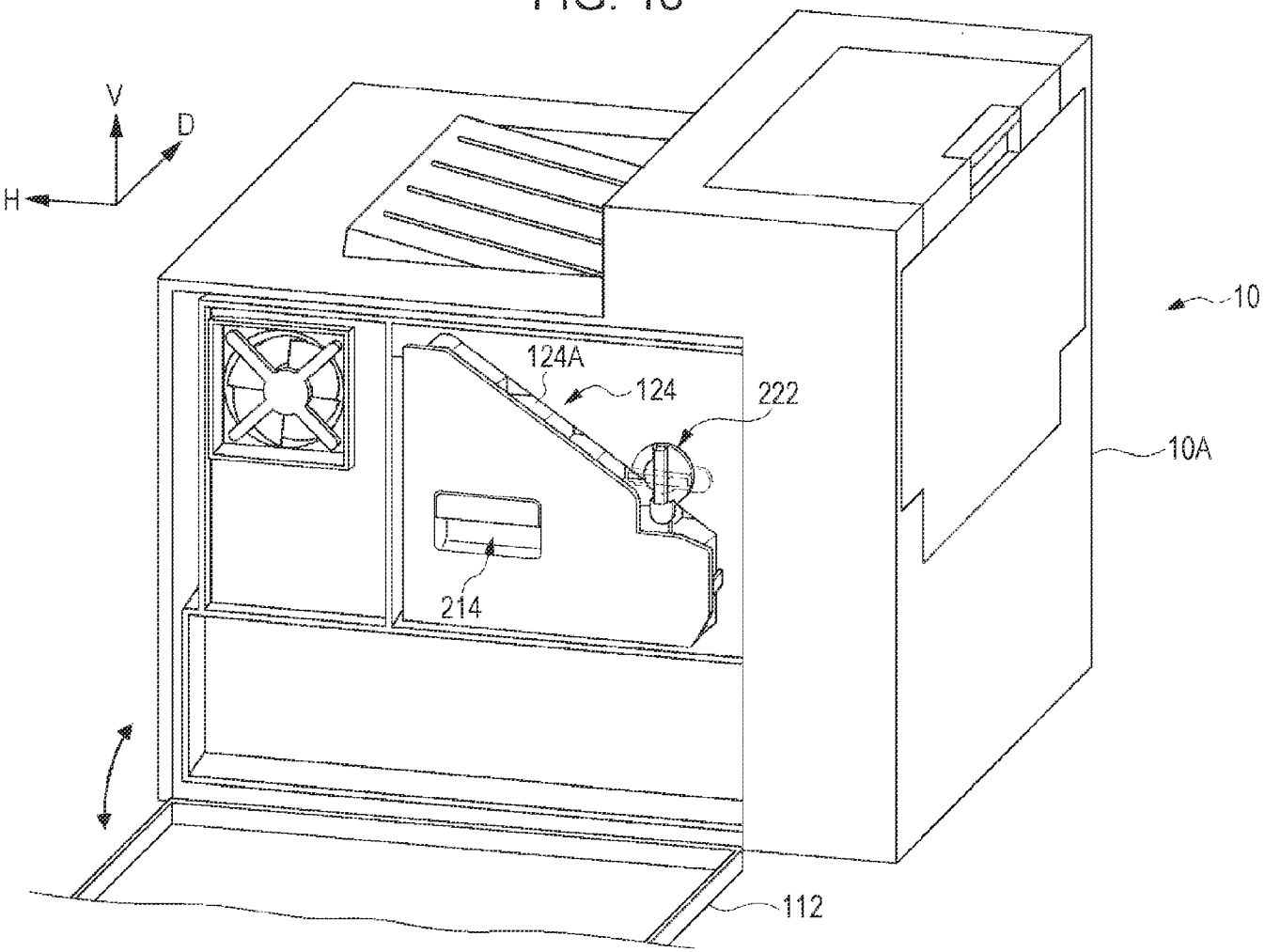
FIG. 18 is a perspective view showing the image forming apparatus according to the exemplary embodiment of the present invention.

The waste toner box 124 is a consumable part to be replaced when filled with waste toner. As shown in FIGS. 17 and 18, the waste toner box 124 is mountable to and removable from the apparatus body 10A. The discharge pipes 150 of the image forming units 16 and the apparatus body 10A extending in the apparatus depth direction are inserted into the waste toner box 124 from insertion ports 178A (see FIG. 8) to be discussed later formed in the waste toner box 124. Therefore, the waste toner box 124 is mounted to and removed from the apparatus body 10A by moving the waste toner box 124 in the apparatus depth direction with respect to the apparatus body 10A.

A container body 124A of the waste toner box 124 is hollow inside. Circular insertion ports 178A for passage of the discharge pipes 150 are formed in a sidewall 178 of the container body 124A that faces toward the image forming units 16 with the waste toner box 124 mounted to the apparatus body 10A.

Figure 8:
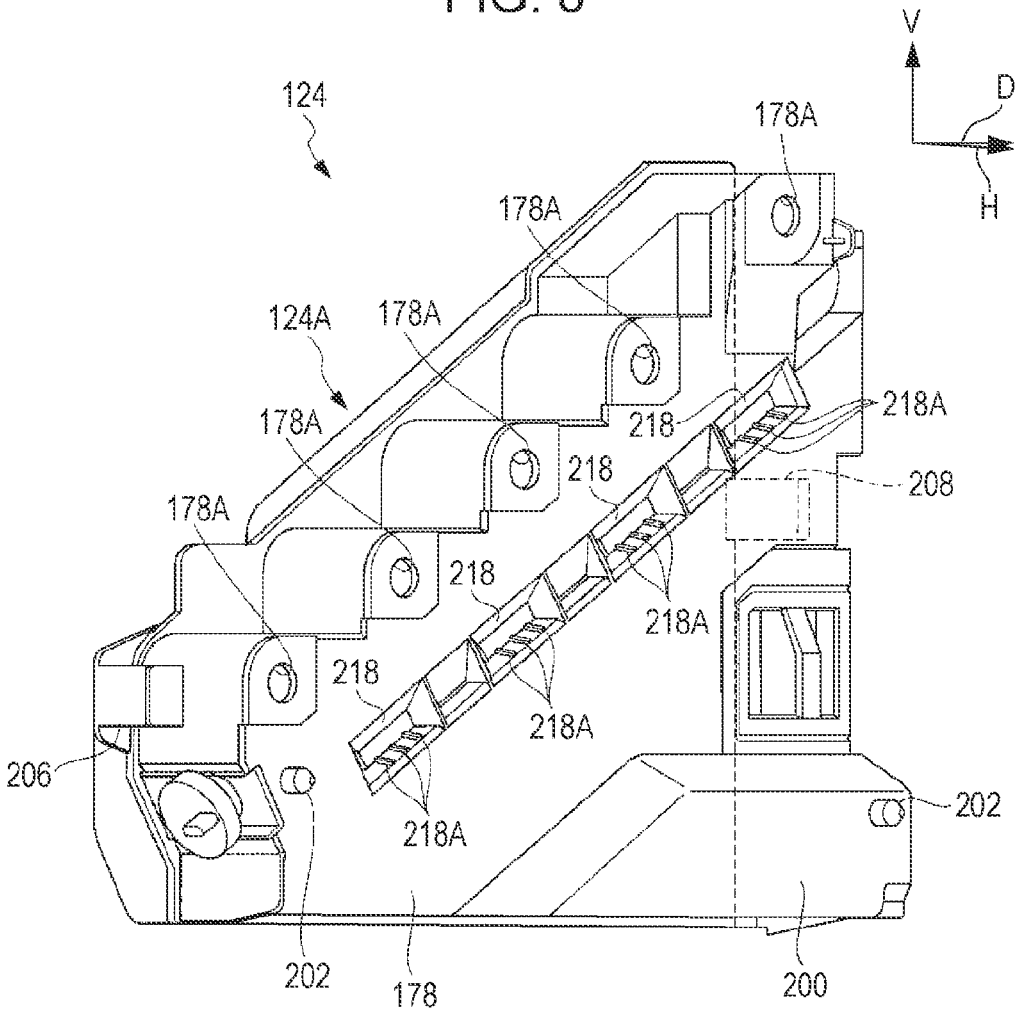
FIG. 8 is a perspective view showing the waste toner box provided in the image forming apparatus according to the exemplary embodiment of the present invention.

As shown in FIG. 8, five insertion ports 178A are formed so as to correspond to the discharge pipes 150. The diameter of the insertion ports 178A is larger than the outside diameter of the discharge pipes 150. The outer peripheral wall of the discharge pipes 150 and the edge defining the insertion ports 178A are spaced from each other with the discharge pipes 150 inserted from the insertion ports 178A.

As shown in FIG. 6, a cylindrical wall 180 extending in the apparatus depth direction toward the insertion port 178A is provided inside the container body 124A. In addition, a sponge-like sealing member 182 is provided at the edge defining each insertion port 178A to seal the space between the sidewall 178 and the cylindrical wall 180.

As shown in FIG. 7, the sealing member 182 also functions as a sealing member that seals the space between the discharge pipe 150 inserted from the insertion port 178A and the sidewall 178.

A projecting portion 184 is provided inside the cylindrical wall 180. The projecting portion 184 projects from the wall surface of the container body 124A toward the inside of the cylindrical wall 180 to extend toward the apparatus back side in the apparatus depth direction. The projecting portion 184 is formed in a bar (column) shape at the axial center portion of the cylindrical wall 180.

When the distal end side of the discharge pipe 150 is inserted from the insertion port 178A to be disposed inside the container body 124A, the projecting portion 184 pushes the distal end surface 168 of the small-diameter portion 164B of the open/close pipe 164 with a distal end 184A against the urging force of the compression coil spring 172 to move the open/close pipe 164 to the opening position (see FIG. 7).

Further, a cylindrical holding portion 186 is formed to project from the wall surface of the container body 124A toward the inside of the cylindrical wall 180 so as to surround the base end side of the projecting portion 184.

A flow-in port 180A is formed on the lower side, in the vertical direction, of an intermediate portion of the cylindrical wall 180 in the apparatus depth direction. The flow-in port 180A allows waste toner discharged from the discharge pipe 150 to flow into the container body 124A.

A shutter 188 capable of opening and closing the flow-in port 180A is disposed inside the cylindrical wall 180. The shutter 188 is formed in the shape of a cylinder provided coaxially with the cylindrical wall 180. The shutter 188 is movable along the inner peripheral wall of the cylindrical wall 180 between a closing position (see FIG. 6) at which the flow-in port 180A of the cylindrical wall 180 is closed and an opening position (see FIG. 7) at which the flow-in port 180A of the cylindrical wall 180 is opened.

An inner cylindrical portion 190 that is cylindrical in shape is formed inside the shutter 188 integrally with the shutter 188. The distal end side of a compression coil spring 194 is disposed between the inner cylindrical portion 190 and the shutter 188. The base end portion of the compression coil spring 194 is held by the holding portion 186. The distal end portion of the compression coil spring 194 contacts a coupling portion 192 that couples between the inner cylindrical portion 190 and the shutter 188.

A surface of the coupling portion 192 on the apparatus back side serves as a pressed surface 192C to be pressed by the pressing surface 152 of the discharge pipe 150.

Meanwhile, as shown in FIG. 8, pins 202 are provided on the sidewall 178 of the apparatus body 124A and a sidewall 200 projected with respect to the sidewall 178. The pins 202 are used to position the waste toner box 124 with respect to the apparatus body 10A. The pins 202 are formed to extend in the apparatus depth direction.

In contrast, as shown in FIG. 11, circular holes 204 that are circular in shape are formed in the apparatus body 10A. The pins 202 are inserted into the circular holes 204 when the waste toner box 124 is moved in the apparatus depth direction to be mounted to the apparatus body 10A.

Figure 9:
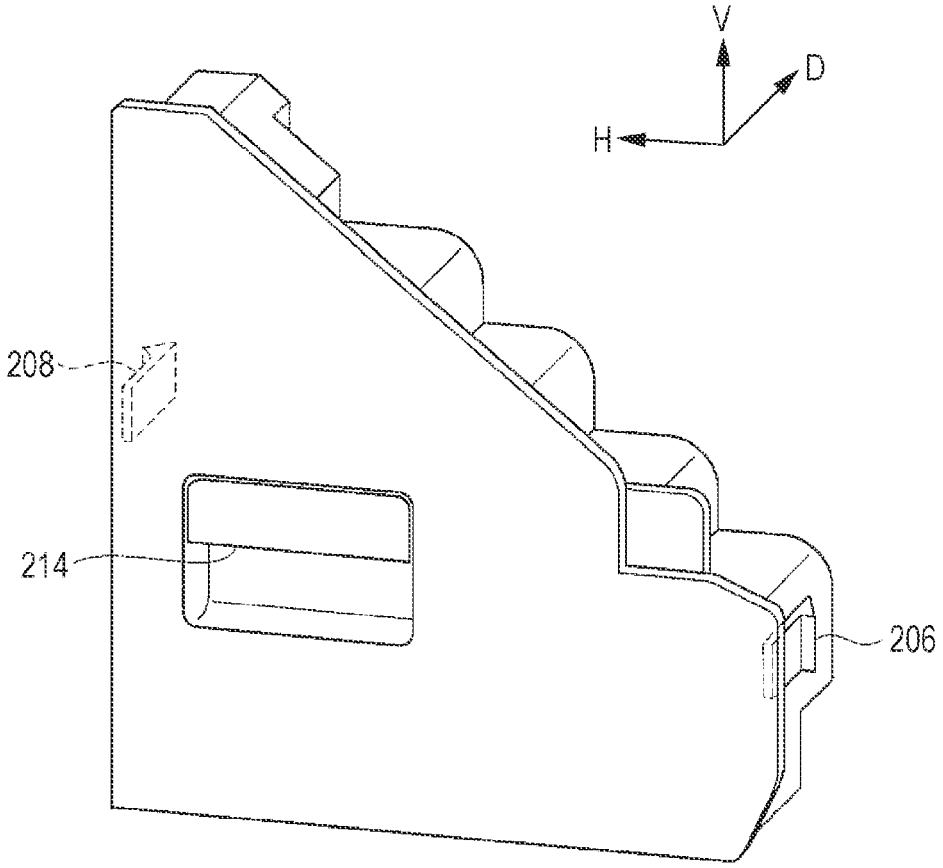
FIG. 9 is a perspective view showing the waste toner box provided in the image forming apparatus according to the exemplary embodiment of the present invention.

Further, as shown in FIGS. 8 and 9, holding hooks 206 and 208 are formed on the container body 124A to hold the waste toner box 124 mounted to the apparatus body 10A at the mounting position of the waste toner box 124. The holding hook 206 is disposed on one side in the apparatus width direction. The holding hook 208 is disposed on the other side in the apparatus width direction.

In contrast, as shown in FIG. 11, two rectangular openings 210A are formed in the apparatus body 10A to be engaged with the holding hooks 206 and 208.

Figure 10:
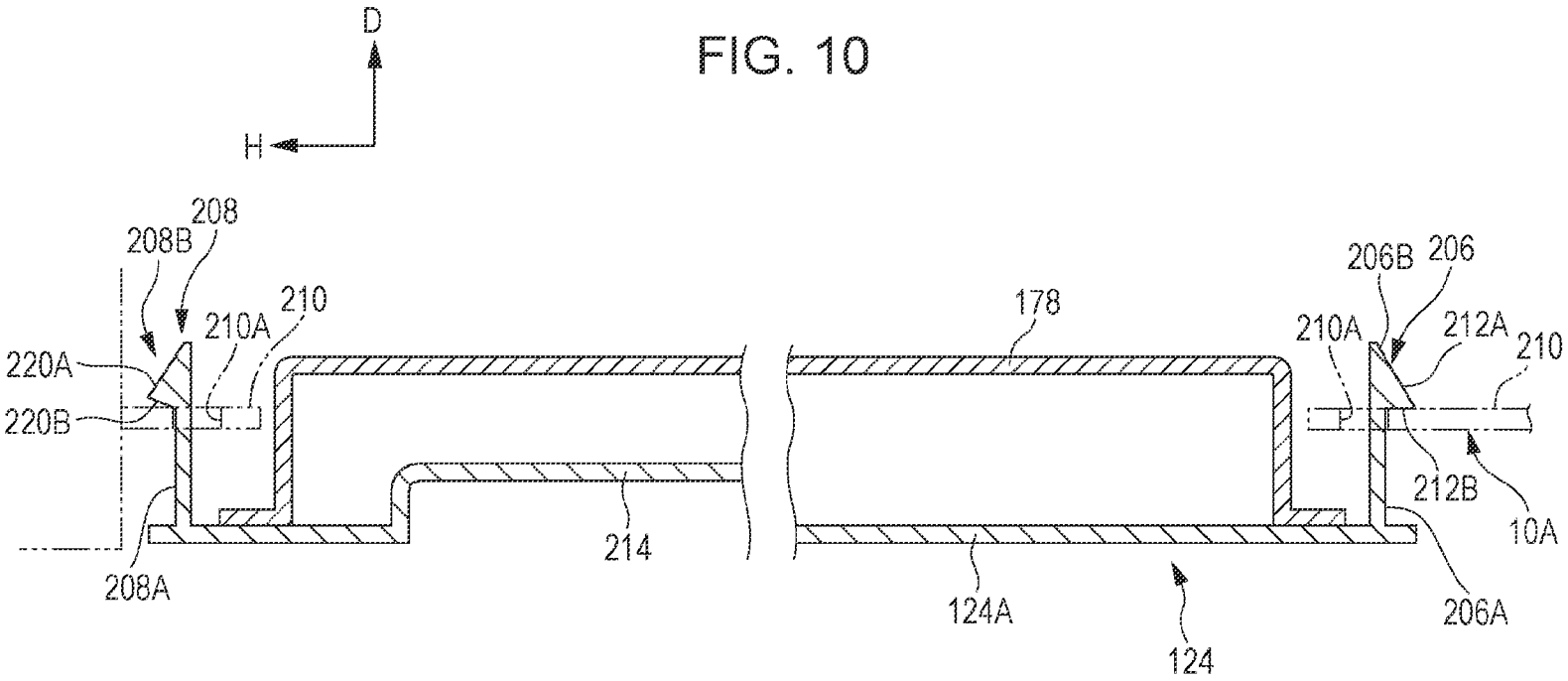
FIG. 10 is a cross-sectional view showing the waste toner box provided in the image forming apparatus according to the exemplary embodiment of the present invention.

As shown in FIG. 10, the holding hook 206 includes a column 206A extending in the apparatus depth direction, and a hook 206B formed integrally with the distal end side of the column 206A. The hook 206B includes an inclined surface 212A inclined so as to become thinner toward the distal end side, and a restricting surface 212B that faces toward the apparatus front side in the apparatus depth direction. With the distal end side of the holding hook 206 inserted from the opening 210A, the restricting surface 212B and a plate surface of a plate member 210, in which the opening 210A is formed, that faces toward the inside of the apparatus contact each other to suppress removal of one side (right side in the drawing) of the waste toner box 124 from the apparatus body 10A toward the apparatus front side.

In contrast, the holding hook 208 includes a column 208A extending in the apparatus depth direction, and a hook 208B formed integrally with the distal end side of the column 208A, as with the holding hook 206. The hook 208B includes an inclined surface 220A inclined so as to become thinner toward the distal end side, and a restricting surface 220B inclined such that the angle formed between the column 208A and the restricting surface 220B is larger than the angle formed between the column 208A and a plane that faces toward the apparatus depth direction. With the distal end side of the holding hook 208 inserted from the opening 210A, the corner portion formed by the restricting surface 220B and the column 208A contacts the edge defining the opening 210A to suppress removal of the other side (left side in the drawing) of the waste toner box 124 from the apparatus body 10A.

Further, as shown in FIG. 9, the container body 124A includes a handle 214 formed to be grasped by an operator when the waste toner box 124 which has been mounted to the apparatus body 10A is to be removed from the apparatus body 10A.

The handle 214 is disposed on the other side of the container body 124A. Pulling the handle 214 toward the apparatus front side disengages the holding hook 208 from the opening 210A, and then disengages the holding hook 206 from the opening 210A. As discussed earlier, the restricting surface 220B formed on the holding hook 208 is inclined such that the angle formed between the column 208A and the restricting surface 220B is larger than the angle formed between the column 208A and a plane that faces toward the apparatus depth direction. Therefore, the holding hook 208 is disengaged from the opening 210A in a single action in contrast to a case where the restricting surface 220B is not inclined.

As shown in FIG. 8, respective recessed portions 218 are formed in the sidewall 178 at locations obliquely below the four insertion ports 178A that allow passage of the discharge pipes 150 of the image forming units 16.

In contrast, as shown in FIGS. 1 and 11, the cover member 105 of the image forming unit 16 includes a projected portion 130 formed to be inserted into the recessed portion 218 by mounting the waste toner box 124 to the apparatus body 10A.

The projected portion 130 includes a wall 130A formed to serve as an example of a second wall that faces downward (toward the restriction removing side of the image forming unit 16) in the vertical direction. Meanwhile, the recessed portion 218 includes three ribs 218A (see FIG. 8) formed to serve as an example of a suppression portion that contacts the wall 130A when the image forming unit 16 is to be moved downward in the vertical direction to suppress movement of the image forming unit 16. The recessed portion 218 including the ribs 218A and the projected portion 130 are shaped such that the recessed portion 218 and the projected portion 130 are spaced from each other in the vertical direction with the waste toner box 124 mounted to the apparatus body 10A.

The minimum distance (indicated by G in FIG. 1) between the wall 130A and the ribs 218A in the vertical direction is smaller than the amount of overlap (indicated by H in FIGS. 1 and 5) between the wall 144A of the recessed portion 144 and the wall 142A of the projecting portion 142 in the vertical direction.

Further, as shown in FIG. 11, the apparatus body 10A includes a handle 222 that is rotated to apply tension to the intermediate transfer belt 42. As shown in FIG. 18, when the handle 222 is rotated with the waste toner box 124 mounted to the apparatus body 10A, a part of the handle 222 overlaps a part of the container body 124A from the apparatus front side. Consequently, the waste toner box 124 is not removed from the apparatus body 10A even if the operator erroneously pulls the handle 214 toward the apparatus front side.

Thus, a member mounting structure according to the exemplary embodiment includes at least one image forming unit 16, the plate spring 100, the plate spring 102, and the restriction section 140 of the image forming unit 16, and the waste toner box 124.

(Function of Construction for Mounting and Removal)

Next, the function etc. of the various members in mounting and removing the image forming units 16 and the waste toner box 124 with respect to the apparatus body 10A will be described.

[Mounting to Apparatus Body]

First, a case where the image forming units 16 and the waste toner box 124 are to be mounted to the apparatus body 10A will be described. As shown in FIG. 12A, the image forming unit 16 is pushed toward the apparatus back side in the holding member axial direction (an example of the first direction) while allowing the first sliding surface 94 and the second sliding surface 96 of the image forming unit 16 to slide over the first guiding surface 82 and the second guiding surface 84, respectively, of the apparatus body 10A.

As shown in FIG. 2A, when the image forming unit 16 is pushed into the apparatus body 10A, the end portion 104D of the bearing member 104 contacts the inclined surface 102B of the plate spring 102.

Next, as shown in FIGS. 2B and 3A, the end portion 104D and the inclined surface 104B of the bearing member 104 push the plate spring 102 to warp the plate spring 102 downward in the vertical direction, and a portion of the image forming unit 16 on the apparatus back side is urged in the vertical direction (an example of the second direction) by the urging force of the plate spring 102. Consequently, the portion of the image forming unit 16 on the apparatus back side is moved upward in the vertical direction. With the inclined surface 104B in contact with the plate spring 102, the image forming unit 16 is pushed back toward the apparatus front side by the urging force of the plate spring 102.

Further, as shown in FIG. 3B, the contact surface 104A of the bearing member 104 reaches the bent portion 102A of the plate spring 102. With the contact surface 104A having reached the bent portion 102A, the urging force of the plate spring 102 causes the contact surface 104C to contact the positioning surface 110A of the positioning member 110, and urges the portion of the image forming unit 16 on the apparatus back side toward the positioning surface 110A.

After the contact surface 104A reaches the bent portion 102A, the inclined surface 105B of the cover member 105 contacts the plate spring 100. Then, as shown in FIGS. 3B and 4, the inclined surface 105B of the cover member 105 pushes the plate spring 100 to warp the plate spring 100 downward in the vertical direction, and a portion of the image forming unit 16 on the apparatus front side is urged upward in the vertical direction by the urging force of the plate spring 100. Consequently, the portion of the image forming unit 16 on the apparatus front side is moved upward in the vertical direction. With the inclined surface 105B in contact with the plate spring 100, the image forming unit 16 is pushed back toward the apparatus front side by the urging force of the plate spring 100.

Then, the contact surface 105A of the cover member 105 reaches the bent portion 100A of the plate spring 100. After that, the projecting portion 142 of the bearing member 108 is moved toward the apparatus back side while contacting the inclined surface 86C of the frame member 86 to be inserted into the recessed portion 144. Then, the urging force of the plate spring 100 causes the contact surface 108A of the bearing member 108 to contact the positioning surface 86A of the frame member 86, and urges the portion of the image forming unit 16 on the apparatus front side toward the positioning surface 86A.

Further, the wall 144A of the recessed portion 144 and the wall 142A of the projecting portion 142 contact each other to restrict movement of the image forming unit 16 toward the removal side in the holding member axial direction. Consequently, the image forming unit 16 is mounted to the apparatus body 10A and disposed at the mounting position.

Next, as shown in FIGS. 17 and 18, the waste toner box 124 is moved in the holding member axial direction from the apparatus front side to be mounted to the apparatus body 10A.

As shown in FIGS. 8 and 11, when the waste toner box 124 is moved from the apparatus front side in the holding member axial direction, the discharge pipes 150 are inserted into the container body 124A from the insertion ports 178A formed in the container body 124A of the waste toner box 124. In addition, the pins 202 formed on the waste toner box 124 are inserted into the circular holes 204 formed in the apparatus body 10A. Further, the holding hooks 206 and 208 are inserted from the openings 210A to be engaged so that the waste toner box 124 is mounted to the apparatus body 10A. Movement of the waste toner box 124 toward the apparatus back side is restricted by contact of the container body 124A with a restriction member (not shown).

As shown in FIGS. 6 and 7, when the discharge pipe 150 is inserted from the insertion port 178A, the distal end 184A of the projecting portion 184 pushes the distal end surface 168 of the open/close pipe 164 to relatively move the open/close pipe 164 with respect to the discharge pipe 150. Consequently, the discharge port 158 is opened (see FIG. 7).

In addition, the pressing surface 152 of the discharge pipe 150 pushes the pressed surface 192C of the shutter 188 to relatively move the shutter 188 with respect to the cylindrical wall 180 to open the flow-in port 180A of the cylindrical wall 180. Consequently, waste toner transported toward the distal end side of the discharge pipe 150 may be collected into the container body 124A.

Further, as shown in FIG. 1, with the waste toner box 124 mounted to the apparatus body 10A, the projected portion 130 is inserted into the recessed portion 218. Then, the ribs 218A formed in the recessed portion 218 and the wall 130A of the projected portion 130 face each other in the vertical direction.

Then, as shown in FIG. 18, the handle 222 is rotated such that a part of the handle 222 overlaps a part of the container body 124A from the apparatus front side. In this state, the maintenance cover 112 (see FIG. 18) is used to close the apparatus body 10A.

[Removal from Apparatus Body]

Next, a case where the image forming units 16 and the waste toner box 124 are removed from the apparatus body 10A will be described.

First, as shown in FIG. 18, the maintenance cover 112 is opened to open the apparatus body 10A. Further, the handle 222 is rotated to remove binding on the container body 124A by the handle 222.

In this state, the handle 214 shown in FIG. 18 is grasped and pulled toward the apparatus front side to disengage the holding hook 208 from the opening 210A, and next disengage the holding hook 206 from the opening 210A (see FIGS. 8 and 10). Then, the pins 202 formed on the waste toner box 124 are pulled out of the circular holes 204 formed in the apparatus body 10A. Further, the discharge pipes 150 are pulled out of the insertion ports 178A formed in the container body 124A of the waste toner box 124.

By thus moving the waste toner box 124 toward the apparatus front side in the apparatus depth direction (holding member axial direction), the waste toner box 124 is removed from the apparatus body 10A.

Next, the projected portion 130 is pressed downward to move a portion of the image forming unit 16 on the apparatus front side downward in the vertical direction and extract the projecting portion 142 from the recessed portion 144 (see FIG. 5).

The subsequent procedures are opposite to the procedures taken for mounting, and the image forming unit 16 is pulled out toward the apparatus front side to remove the image forming unit 16 from the apparatus body 10A.

As has been described above, as shown in FIG. 1, with the image forming units 16 and the waste toner box 124 mounted to the apparatus body 10A (disposed at the mounting position), the wall 130A of the projected portion 130 and the ribs 218A in the recessed portion 218 face each other across a gap. In addition, the minimum distance (indicated by G in FIG. 1) between the wall 130A and the ribs 218A in the vertical direction is smaller than the amount of overlap (indicated by H in FIGS. 1 and 5) between the wall 144A of the recessed portion 144 and the wall 142A of the projecting portion 142 in the vertical direction.

When the image forming unit 16 is moved in the vertical direction, the wall 130A of the projected portion 130 is caused to contact the ribs 218A in the recessed portion 218, and therefore a force in the vertical direction is input to the waste toner box 124. The waste toner box 124 is mountable to and removable from the apparatus body 10A by moving the waste toner box 124 in the holding member axial direction different from the vertical direction.

With the waste toner box 124 mounted to the apparatus body 10A, the recessed portion 218 including the ribs 218A and the projected portion 130 are spaced from each other in the vertical direction.

As shown in FIG. 10, the restricting surface 220B formed on the holding hook 208 is inclined such that the angle formed between the column 208A and the restricting surface 220B is large.

While a specific exemplary embodiment of the present invention has been described in detail above, the present invention is not limited to such an exemplary embodiment. It is apparent to those skilled in the art that a variety of other exemplary embodiments may fall within the scope of the present invention. For example, the member mounting structure is used in the image forming apparatus 10 in the exemplary embodiment described above. However, the member mounting structure may be used in other devices.

What is claimed is:

1. A member mounting structure comprising:

a removable member mountable to and removable from an apparatus body by applying a moving force in a first direction to the removable member;

a moving member that moves the removable member in a second direction intersecting the first direction when the removable member is moved in the first direction to be mounted to the apparatus body to dispose the removable member at a mounting position with respect to the apparatus body;

a restriction member that restricts movement of the removable member disposed at the mounting position toward a removal side in the first direction; and a suppression member that is mountable to and removable from the apparatus body by moving the suppression member in the first direction and that suppresses movement of the removable member disposed at the mounting position toward a restriction removing side in the second direction on which restriction imposed by the restriction member is removed, wherein the removable member includes a wall formed to face the restriction removing side in the second direction for removing restriction on the removable member, and wherein the suppression member includes a suppression portion that contacts the wall to suppress movement of the removable member when the removable member disposed at the mounting position is moved toward the restriction removing side in the second direction.

2. The member mounting structure according to claim 1, wherein the restriction member includes another wall that is formed on the removable member and that faces the removal side in the first direction for removal of the removable member, and a contact portion that is formed on the apparatus body and that contacts the another wall when the removable member disposed at the mounting position is moved toward the removal side in the first direction.

3. The member mounting structure according to claim 2, wherein a gap is formed between the wall and the suppression portion in the second direction with the suppression member mounted to the apparatus body.

4. An image forming apparatus comprising:

a member mounting structure according to claim 2, wherein the removable member is an image forming unit including an image holding member, on an outer peripheral surface of which a toner image to be transferred to a transfer target member is formed, and the suppression member is a collection member that collects residual toner remaining on the outer peripheral surface of the image holding member without being transferred to the transfer target member.

5. An image forming apparatus comprising:

a member mounting structure according to claim 2, wherein the removable member is an image forming unit including an image holding member, on an outer peripheral surface of which a toner image to be transferred to a transfer target member is formed, and the suppression member is a collection member that collects residual toner remaining on the outer peripheral surface of the image holding member without being transferred to the transfer target member.

6. The member mounting structure according to claim 1, wherein a gap is formed between the wall and the suppression portion in the second direction with the suppression member mounted to the apparatus body.

7. An image forming apparatus comprising:

a member mounting structure according to claim 6, wherein the removable member is an image forming unit including an image holding member, on an outer peripheral surface of which a toner image to be transferred to a transfer target member is formed, and the suppression member is a collection member that collects residual toner remaining on the outer peripheral surface of the image holding member without being transferred to the transfer target member.

8. An image forming apparatus comprising:

a member mounting structure according to claim 1, wherein the removable member is an image forming unit including an image holding member, on an outer peripheral surface of which a toner image to be transferred to a transfer target member is formed, and the suppression member is a collection member that collects residual toner remaining on the outer peripheral surface of the image holding member without being transferred to the transfer target member.

* * * * *